US011851950B2

(12) United States Patent
Andrews et al.

(10) Patent No.: US 11,851,950 B2
(45) Date of Patent: Dec. 26, 2023

(54) LADDER STABILIZER

(71) Applicants: Stephen D. Andrews, Norman, OK (US); Robert S. Buchanan, Jr., Norman, OK (US); Charles W. Andrews, Norman, OK (US); Shea K. Wesson, Norman, OK (US)

(72) Inventors: Stephen D. Andrews, Norman, OK (US); Robert S. Buchanan, Jr., Norman, OK (US); Charles W. Andrews, Norman, OK (US); Shea K. Wesson, Norman, OK (US)

(73) Assignee: Ladder Armor LLC, Norman, OK (US)

( * ) Notice: Subject to any disclaimer, the term of this patent is extended or adjusted under 35 U.S.C. 154(b) by 0 days.

(21) Appl. No.: 17/863,134

(22) Filed: Jul. 12, 2022

(65) Prior Publication Data

US 2023/0023715 A1 Jan. 26, 2023

Related U.S. Application Data

(60) Provisional application No. 63/221,279, filed on Jul. 13, 2021.

(51) Int. Cl.

| | |
|---|---|
| ***E06C 7/42*** | (2006.01) |
| ***E06C 7/18*** | (2006.01) |
| ***E06C 7/44*** | (2006.01) |

(52) U.S. Cl.

CPC ..... *E06C 7/423* (2013.01); *E06C 7/188* (2013.01); *E06C 7/42* (2013.01); *E06C 7/44* (2013.01)

(58) Field of Classification Search

CPC ... E06C 7/423; E06C 7/48; E06C 7/44; E06C 7/482; E06C 7/484; E06C 1/34; E06C 7/188; E06C 7/42; E06C 7/16

USPC ..... 182/172

See application file for complete search history.

(56) References Cited

U.S. PATENT DOCUMENTS

| | | | | | |
|---|---|---|---|---|---|
| 549,910 | A * | 11/1895 | Endriss | E06C 7/48 | 182/214 |
| 2,327,317 | A * | 8/1943 | Randall | E06C 7/44 | 182/214 |
| 2,459,437 | A * | 1/1949 | Kreissler | E06C 7/16 | 182/121 |
| 2,680,554 | A * | 6/1954 | Dakin | E06C 7/48 | 182/120 |

(Continued)

FOREIGN PATENT DOCUMENTS

| | | | | |
|---|---|---|---|---|
| FR | 2675882 A1 * | 10/1992 | E04G 1/34 | |
| GB | 2182086 A * | 5/1987 | E06C 7/423 | |

(Continued)

OTHER PUBLICATIONS

Ladder Spurs page from website www.laddersafetycompany.com.
Power Point containing ladders.

*Primary Examiner* — Taylor Morris
(74) *Attorney, Agent, or Firm* — McAfee & taft

(57) ABSTRACT

A ladder stabilizer for step ladders and extension ladders. The ladder stabilizer is collapsible for storage. Additionally, the ladder stabilizer includes legs that are adjustable in length and pivotally secured to a rigid lateral support. The rigid lateral support also carries a step plate secured by a hinge to the lateral support. The step plate provides the point of engagement between the ladder stabilizer and a rung of the ladder.

35 Claims, 17 Drawing Sheets

(56) References Cited

U.S. PATENT DOCUMENTS 2,868,427 A 1/1959 Hess
2,881,028 A * 4/1959 Baird ..... E06C 7/16 182/120
2,903,086 A * 9/1959 Chubbs ..... E06C 7/484 182/229
2,997,127 A 8/1961 Wojtowicz
3,713,510 A * 1/1973 O'Dell ..... E06C 7/48 182/20
3,878,917 A * 4/1975 McBride ..... E06C 1/20 182/172
3,891,054 A 6/1975 Larson
3,901,354 A 8/1975 Grebausky
4,049,283 A * 9/1977 Brookes ..... E06C 7/50 182/127
4,147,231 A 4/1979 Chantler et al.
4,331,217 A * 5/1982 Stecklow ..... E06C 7/16 248/238
4,359,138 A * 11/1982 Kummerlin ..... E06C 7/44 248/238
4,433,754 A 2/1984 Beach
4,502,566 A * 3/1985 Wing ..... E06C 7/48 182/214
4,519,477 A 5/1985 Ralston
4,872,529 A 10/1989 Viets
4,896,745 A * 1/1990 Warnelov ..... E06C 7/44 248/188.2
5,242,031 A * 9/1993 Ashley ..... E06C 7/48 182/129
5,417,302 A 5/1995 McElfresh
5,590,739 A * 1/1997 High ..... E06C 1/397 182/208
5,664,643 A * 9/1997 Taylor, Jr. ..... E06C 7/48 182/214
6,672,427 B1 * 1/2004 Sheffield ..... E06C 7/42 182/172
6,691,825 B2 * 2/2004 Haig ..... E06C 7/14 248/238
7,293,630 B1 11/2007 Trebee
7,757,814 B2 7/2010 Pleadwell et al.
8,220,852 B2 * 7/2012 Fenstemaker ..... B25F 1/02 294/51
8,528,695 B1 * 9/2013 Orpia ..... E06C 7/48 182/206
8,607,932 B2 * 12/2013 Cooper ..... E06C 7/423 182/172
8,839,906 B1 * 9/2014 Furr ..... E06C 7/482 182/214
8,869,935 B2 * 10/2014 Baglin ..... E06C 7/16 182/116
8,979,053 B2 * 3/2015 Deal ..... E06C 7/48 248/237
9,109,395 B2 * 8/2015 Reitz ..... E06C 7/188
9,932,771 B1 * 4/2018 Bramwell ..... E06C 7/182
10,161,185 B2 12/2018 Pascut
10,619,416 B1 * 4/2020 Snell ..... E06C 7/06
2002/0074187 A1 6/2002 Bendle et al.
2004/0216955 A1 * 11/2004 Unger ..... E06C 7/482 182/206
2005/0139425 A1 * 6/2005 Thomas ..... E06C 1/34 182/214
2005/0161287 A1 * 7/2005 Hosp ..... B62B 1/18 182/200
2006/0054398 A1 3/2006 Swann
2007/0289812 A1 12/2007 Feemster et al.
2008/0185225 A1 8/2008 Spengler
2008/0314682 A1 12/2008 Cogswell et al.
2009/0255759 A1 * 10/2009 Barnes ..... E06C 7/482 182/204
2010/0326770 A1 * 12/2010 Clifford ..... E06C 7/423 182/214
2011/0017549 A1 1/2011 Lietz
2011/0168492 A1 7/2011 Johnson
2011/0226551 A1 9/2011 Iverson et al.
2020/0149348 A1 * 5/2020 Khwaja ..... E06C 1/12

FOREIGN PATENT DOCUMENTS

WO WO-8302796 A1 * 8/1983 ..... E04G 1/24
WO WO-2012168684 A1 * 12/2012 ..... E04G 1/24

* cited by examiner

LADDER STABILIZER

BACKGROUND

Each year, falls from ladders lead to thousands of emergency room visits. Ladders are necessarily used on construction sites and around the house to enable access to a wide variety of fixtures and construction projects. Unfortunately, even a slight difference in elevation between the legs of a ladder can produce unsteadiness leading to a loss of balance and an injury producing fall. An adjustable and easily deployable ladder stabilizer will improve the safety of projects requiring the use of a ladder.

SUMMARY

In one aspect the present disclosure provides a ladder stabilizer having: a rigid lateral support, the lateral support formed from at least one hollow tube, the hollow tube having a first end and a second end;

- a first extension arm having a first end and a second end, the first extension arm first end positioned within the first end of the hollow tube;
- a second extension arm having a first end and a second end, the second extension arm first end positioned within the second end of the hollow tube;
- a support beam secured to the rigid lateral support;
- a step plate secured by a hinge to the support beam;
- a first leg having a first end and a second end, the first end of the first leg pivotally secured to the first extension arm;
- a second leg having a first end and a second end, the first end of the first leg pivotally secured to the second extension arm.

In another aspect, the present disclosure describes a ladder stabilizer wherein the rigid lateral support includes at least two hollow tubes and each hollow tube has a radius of curvature. The extension arms are configured with a corresponding radius of curvature such that the extension arms may be received within the curved hollow tubes. Typically, each curved hollow tube of the rigid lateral support receives only one curved extension arm.

BRIEF DESCRIPTION OF THE DRAWINGS

FIG. 6 is a back perspective view of the ladder stabilizer with one leg deployed and the step plate collapsed.

FIG. 8 is a back perspective view of the ladder stabilizer with the step plate in the deployed position, the legs deployed and extension arms deployed.

FIGS. 16A and 16B depict one suitable pivoting joint used to permit movement of stabilizer legs from the stored to the deployed position with FIG. 16A depicting the deployed position and FIG. 16B depicting the stored position.

FIGS. 18 and 19 depict the pivoting joint in the deployed position with retaining pins securing the leg at a desired length and the extension arm in the retracted position.

FIG. 23 is a close up view of area A in FIG. 21.

FIG. 26 is a back perspective view of the ladder stabilizer with the step plate in the deployed position, the legs deployed, extension arms deployed and a rigid lateral support in the form of a single hollow tube.

DETAILED DESCRIPTION

Figure 1:
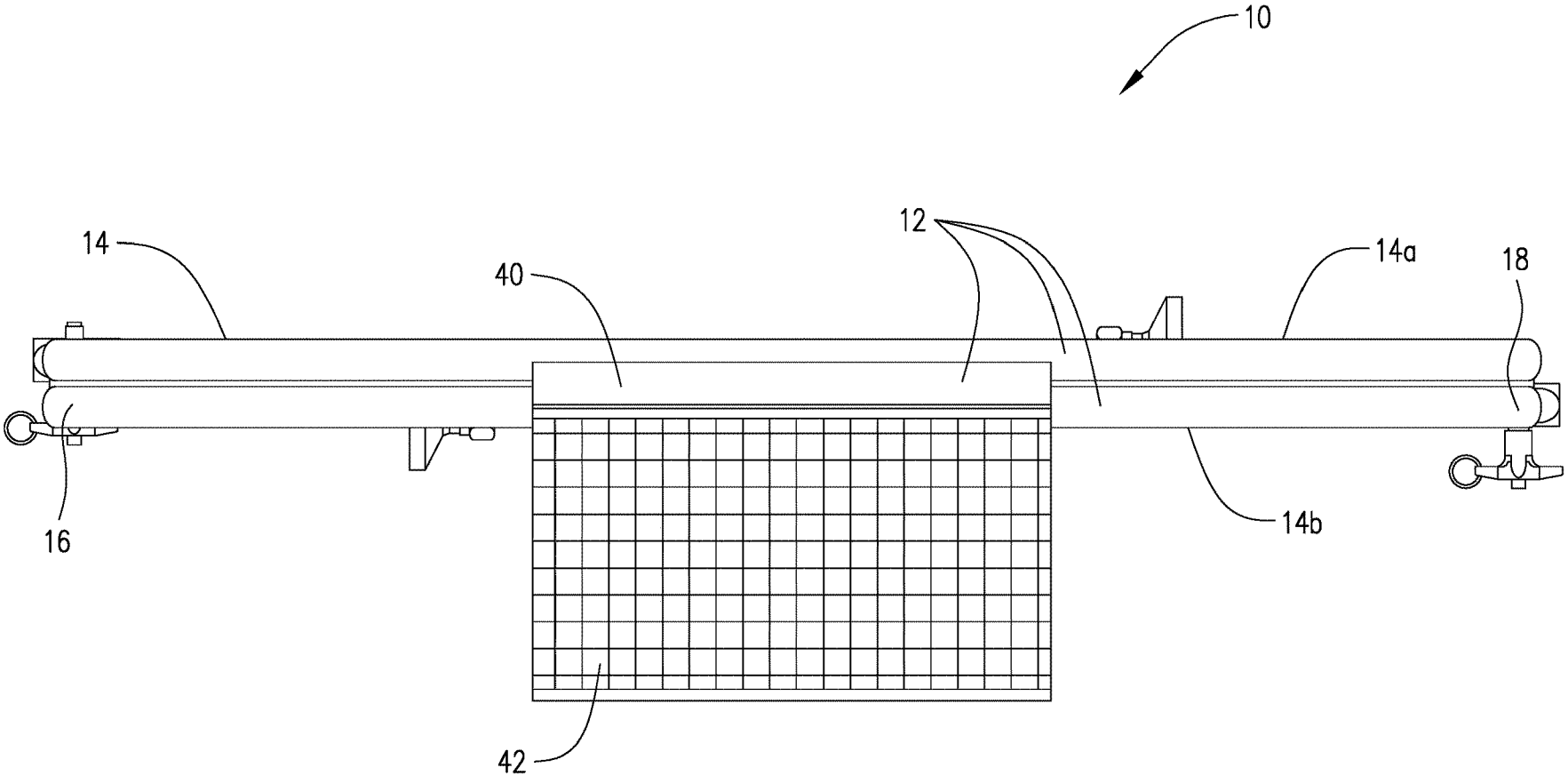
FIG. 1 is a front view of the ladder stabilizer in a collapsed configuration.

The drawings included with this application illustrate certain aspects of the embodiments described herein. However, the drawings should not be viewed as exclusive embodiments. For simplicity and clarity of illustration, where appropriate, reference numerals may be repeated among the different figures to indicate corresponding or analogous elements and the drawings are not necessarily to scale. Throughout this disclosure, the terms "about", "approximate", and variations thereof, are used to indicate that a value includes the inherent variation or error for the device, system, the method being employed to determine the value, or the variation that exists among the study subjects. Finally, the description is not to be considered as limiting the scope of the embodiments described herein.

FIGS. 1-8 depict ladder stabilizer 10 in collapsed configuration, partially deployed configuration and deployed configuration. To provide for the desired stability, ladder stabilizer 10 is configured to extend beyond the width of the ladder 5 being used. Ladder 5 may be an extension ladder, a step ladder or other ladder configuration. As known to those skilled in the art, ladder 5 has at least one pair of legs 9 and at least two rungs 7.

Ladder stabilizer 10 has a rigid lateral support 12 formed from at least one hollow tube 14. Although shown as a round tube, hollow tube 14 may have any cross-sectional geometry. Additionally, hollow tube 14 may be substantially straight or have a radius of curvature. In most embodiments, ladder stabilizer 10 will utilize two hollow tubes 14*a*, 14*b* each having a radius of curvature. Each hollow tube 14*a*, 14*b* has a first end 16 and a second end 18. Typically, rigid lateral support 12 will include each hollow tube 14 and a support beam 40.

Figure 4:
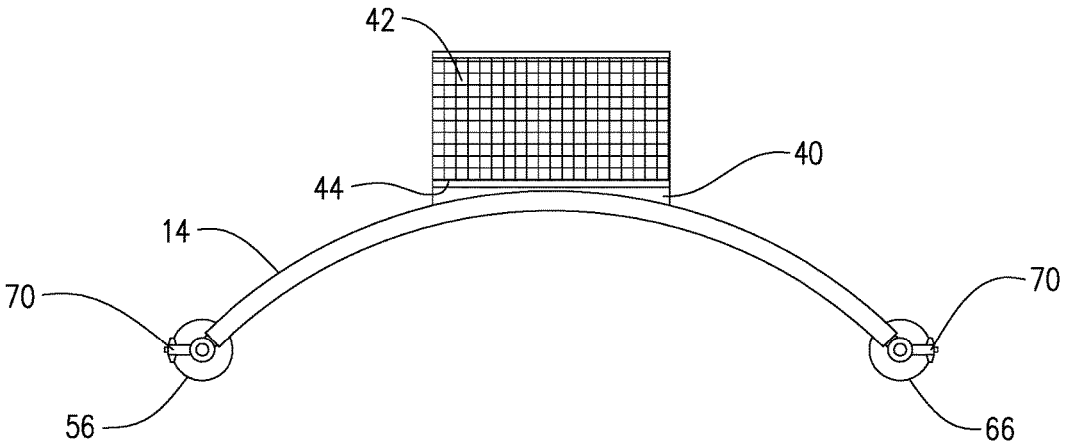
FIG. 4 is a top view of the ladder stabilizer with the step plate in the deployed position and extension arms retracted.
Figure 5:
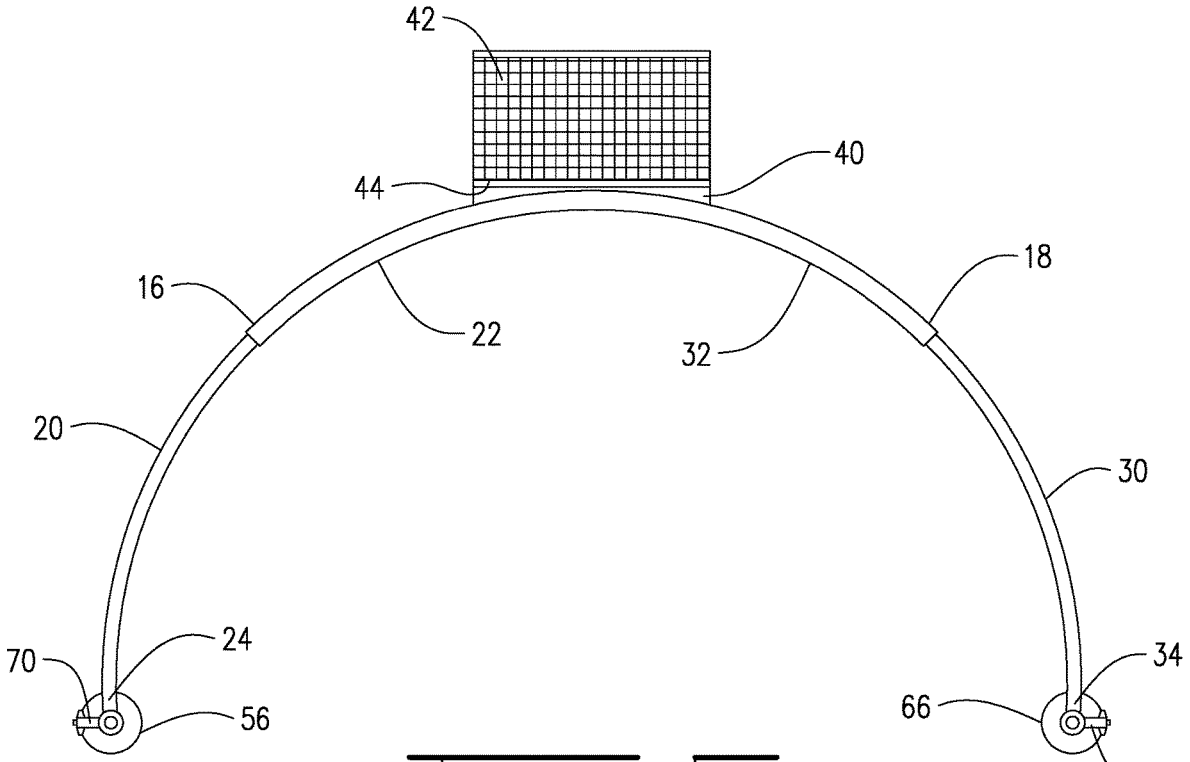
FIG. 5 is a top view of the ladder stabilizer with the step plate in the deployed position and extension arms in the deployed position.
Figure 5:
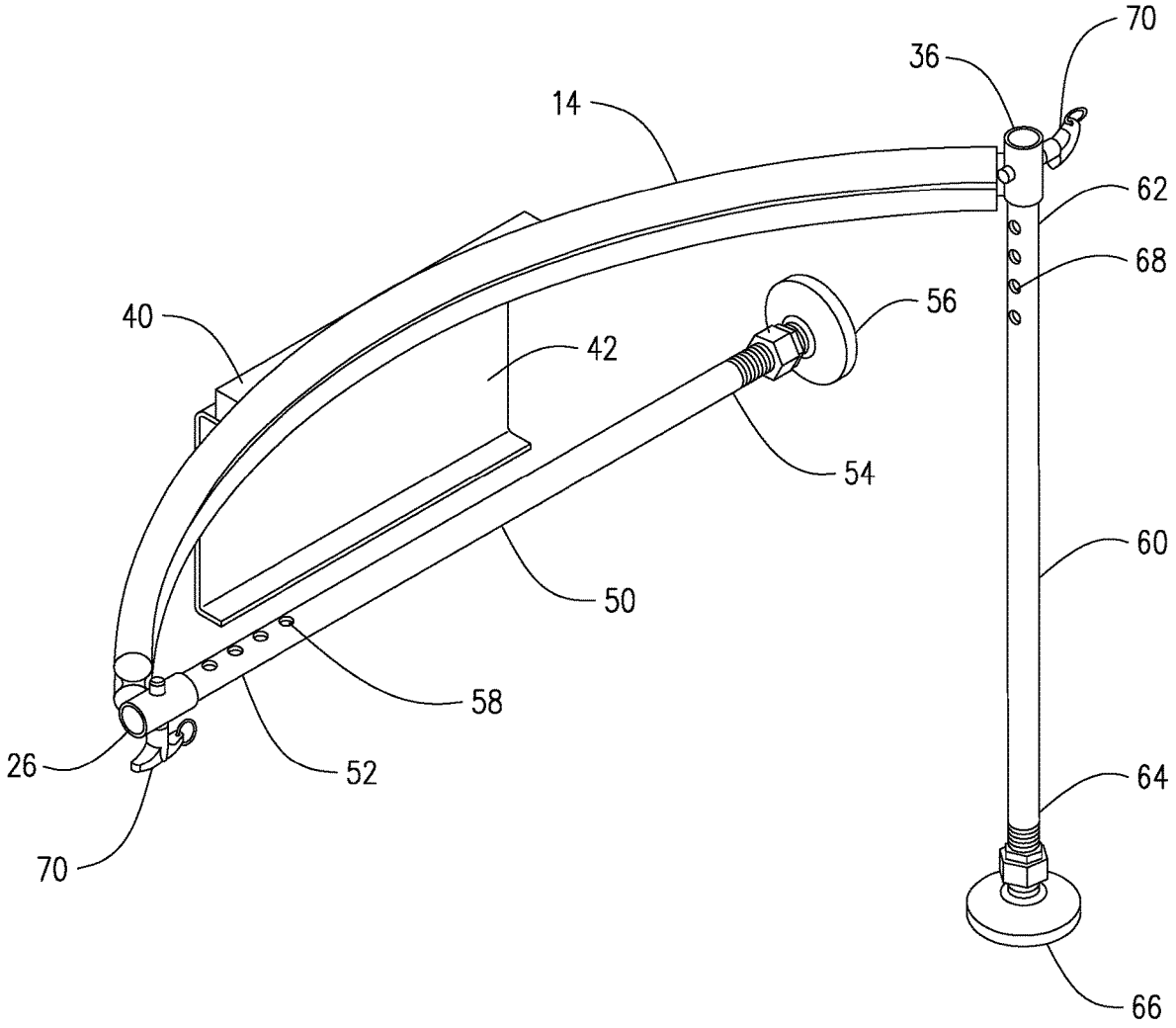

As depicted in FIGS. 4-5, to provide enhanced stabilization in the deployed position, a first extension arm 20 is positioned within hollow tube 14*a*. First extension arm 20 has a first end 22 and a second end 24. First end 22 passes through first end 16 of hollow tube 14*a*. The length of first extension arm 20 may vary depending on whether or not rigid lateral support 12 has one or two hollow tubes 14. Typically, first extension arm 20 will have a length equal to at least 30% of hollow tube 14*a*. More commonly, first extension arm 20 will have a length at least equal to and preferably greater than 50% of hollow tube 14*a*. Thus, when in the stored or collapsed configuration first end 22 is positioned to the interior of hollow tube 14*a* and second end 24 extends beyond first end 16 of hollow tube 14*a*. The outside diameter or outside cross-sectional geometry of first extension arm 20 corresponds to the inside diameter/cross-sectional geometry of hollow tube 14*a* and is sized to provide a snug fit without excess play between the two components. When hollow tube 14*a* has a radius of curvature, first extension arm 20 will have a corresponding radius of curvature to permit smooth passage of first extension arm 20 through hollow tube 14*a*.

First end 22 of extension arm 20 optionally carries at least one and typically two locking buttons 23. Locking buttons 23 are biased outwards by a spring, not shown. When moved to the extended or deployed position as depicted in FIG. 8, locking button(s) 23 will extend outwards through optional holes 25 in tube first end 16 thereby securing extension arm in the deployed position.

A second extension arm 30 has a first end 32 and a second end 34. First end 32 passes through second end 18 of hollow tube 14*b*. The length of second extension arm 30 may vary depending on whether or not rigid lateral support 12 has one or two hollow tubes 14. Typically, second extension arm 30 will have a length equal to at least 30% of hollow tube 14*b*. More commonly, second extension arm 30 will have a length at least equal to and preferably greater than 50% of hollow tube 14*b*. Thus, when in the stored or collapsed configuration first end 32 is positioned to the interior of hollow tube 14 and second end 34 extends beyond second end 18 of hollow tube 14*b*. The outside diameter or outside cross-sectional geometry of second extension arm 30 corresponds to the inside diameter/cross-sectional geometry of hollow tube 14*b* and is sized to provide a snug fit without excess play between the two components. When hollow tube 14*b* has a radius of curvature, second extension arm 30 will have a corresponding radius of curvature to permit smooth passage of second extension arm 30 through hollow tube 14*b*.

First end 32 of extension arm 30 optionally carries at least one and typically two locking buttons 33. Locking buttons 33 are biased outwards by a spring, not shown. When moved to the extended or deployed position as depicted in FIG. 8, locking button(s) 33 will extend outwards through optional hole(s) 35 in tube second end 18 thereby securing extension arm in the deployed position.

Locking buttons 23 and 33 are one suitable configuration for retaining extension arms 20, 30 in the deployed and stored positions. However, other suitable configurations would also include cotter pins, t-handle pins and/or other pins passing through holes in the same location as locking buttons 23, 33 and holes 25, 35.

In one embodiment, the diameter of first and second extension arms 20, 30 may range to be about 0.75" to about 1" with lengths ranging between about 30 inches and about 50 inches. When extension arms 20, 30 have a bend or curvature configuration, the radius of the curvature may range between about 20 inches and about 30 inches, i.e. the curvature would provide a full circle having a diameter between about 40 inches and about 60 inches. When extension arms 20, 30 are fully deployed in the curved configuration, arms 20, 30 define an arc ranging from about 90° to about 180°. When extension arms 20, 30 are in a straight configuration, the length of each arm may range between about 40 inches and about 60 inches. The lateral extension of arms 20, 30 will typically be between about 1.75 times the width of the bottom step of ladder 5 and about 2.5 times the width of the bottom step of ladder 5. In other words, the distance from leg 50 to leg 60 in the deployed position will be about 1.75 times the width of ladder 5 at bottom rung 7 to about 2.5 times the width of ladder 5 at bottom rung 7. Finally, when in the partially stored or stored position, i.e. the legs are still pointed toward the surface of the ground but extension arms 20, 30 have been retracted, the arc defined between receiver 26 and receiver 36 may range from about 45° to 80°. More typically, this arc will be about 60°. See FIG. 4. Typically, in the deployed configuration, with extension arms 20, 30 fully extended, the arc will be about 110° to about 180°.

Figure 2:
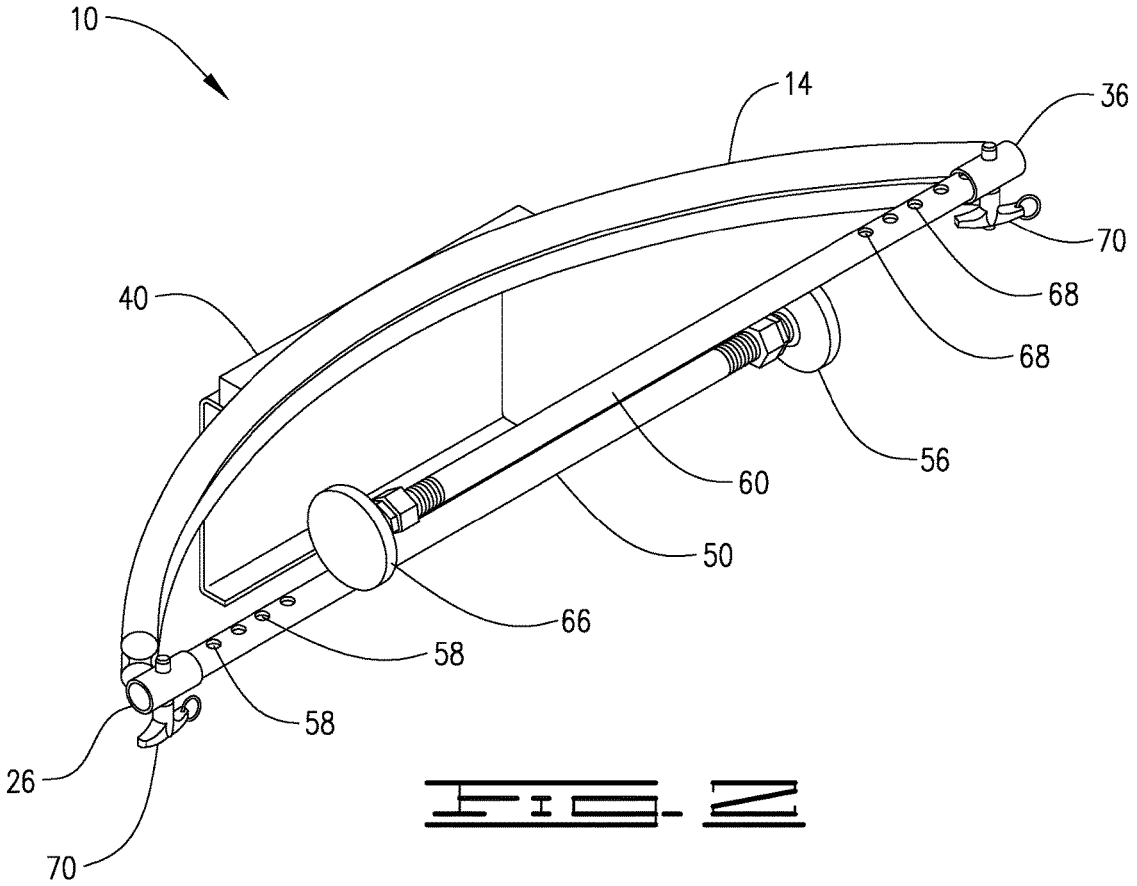
FIG. 2 is a back perspective view of the ladder stabilizer in a collapsed configuration.
Figure 7:
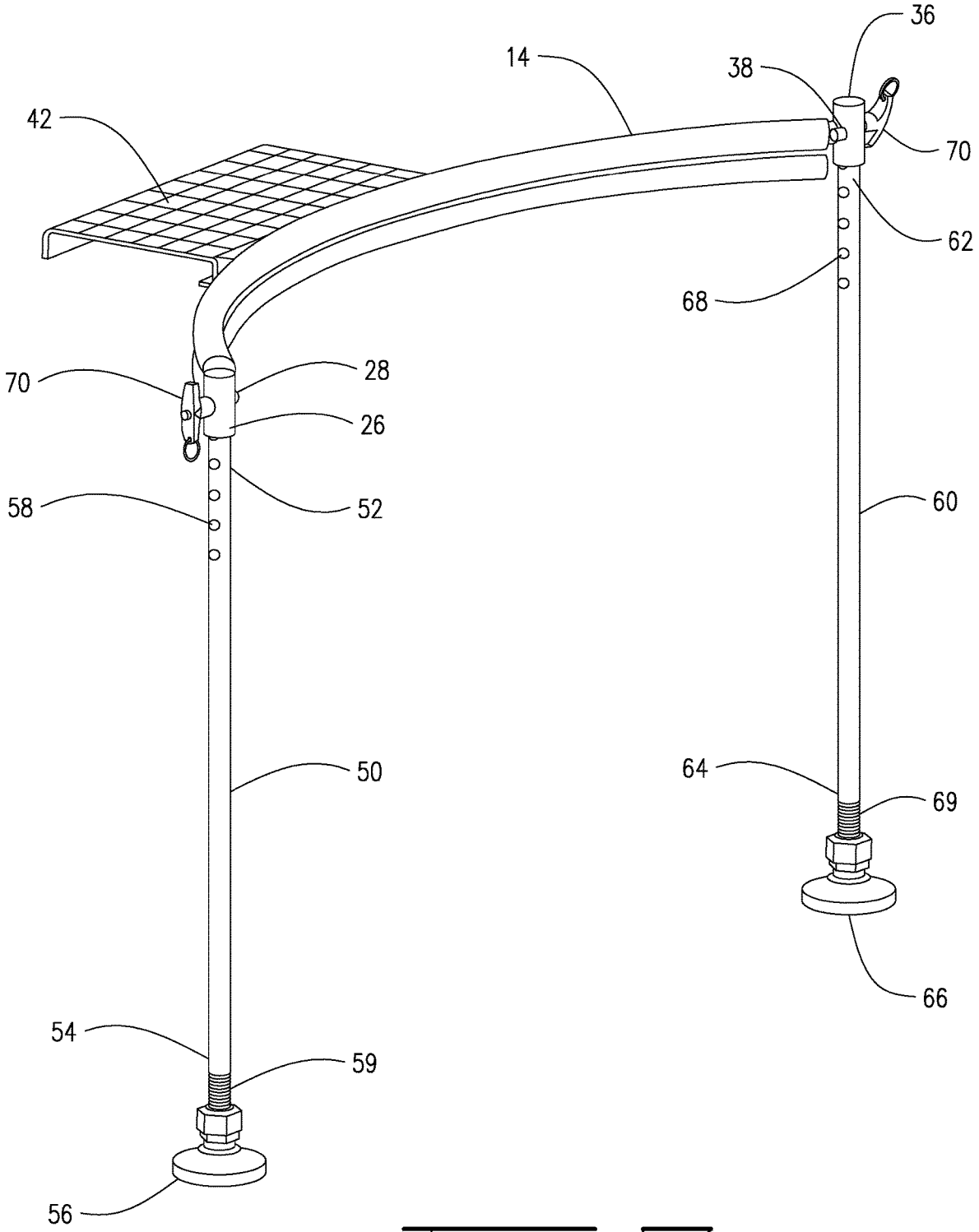
FIG. 7 is a back perspective view of the ladder stabilizer with the step plate in the deployed position, the legs deployed and extension arms retracted.
Figure 5:
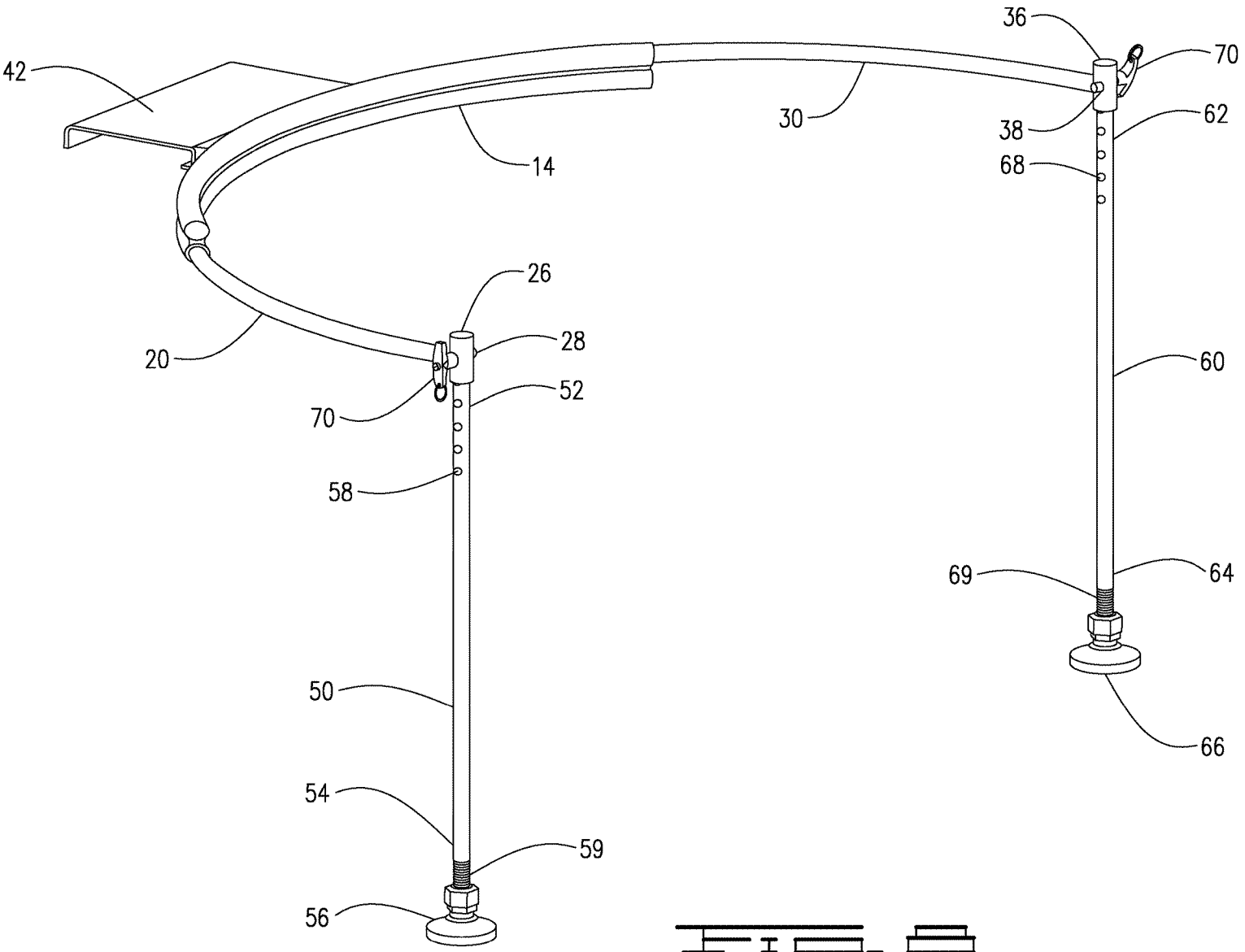
Figure 9:
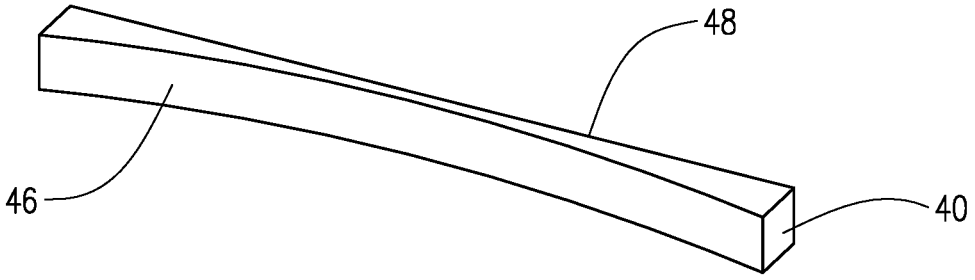
FIG. 9 is a perspective view of a support beam.

As best seen in FIGS. 1-5, a support beam 40 enhances the structural rigidity of hollow tube 14. If two hollow tubes 14*a*, 14*b* are used, then both hollow tubes 14*a*, 14*b* are typically secured to the second side 48 of support beam 40. Tube 14 or tubes 14*a*, 14*b* may be secured to support beam 40 by any convenient method including welding, bolting or riveting. When using curved hollow tubes 14*a*, 14*b*, the first side 46 of support beam 40 optionally has a radius of curvature corresponding to that of curved hollow tubes 14*a*, 14*b*. Support beam 40 also carries a step plate 42. In one embodiment, a hinge 44 secures step plate 42 to beam 40. Hinge 44 may permit rotation of step plate 42 through 180°. Alternatively, to enhance securement of step plate 42 to a rung of ladder 5, hinge 44 may limit step plate to 90° of movement such that step plate 42 projects directly outward (horizontal) from beam 40 in the deployed position, as shown in FIG. 7, and may drop downward when in the collapsed position, as shown in FIGS. 2 and 6. Alternatively, step plate 42 may be secured to support beam 40 or hollow tube 14 in a fixed manner.

Figure 13:
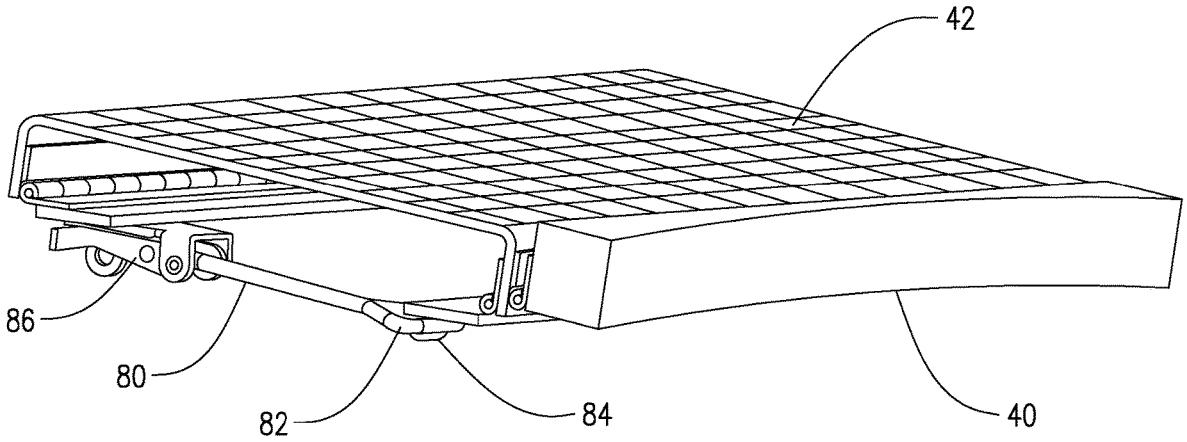
FIGS. 13 and 14 depict a step plate in the deployed position and a latching mechanism for securing a step plate to a ladder rung or step.
Figure 14:
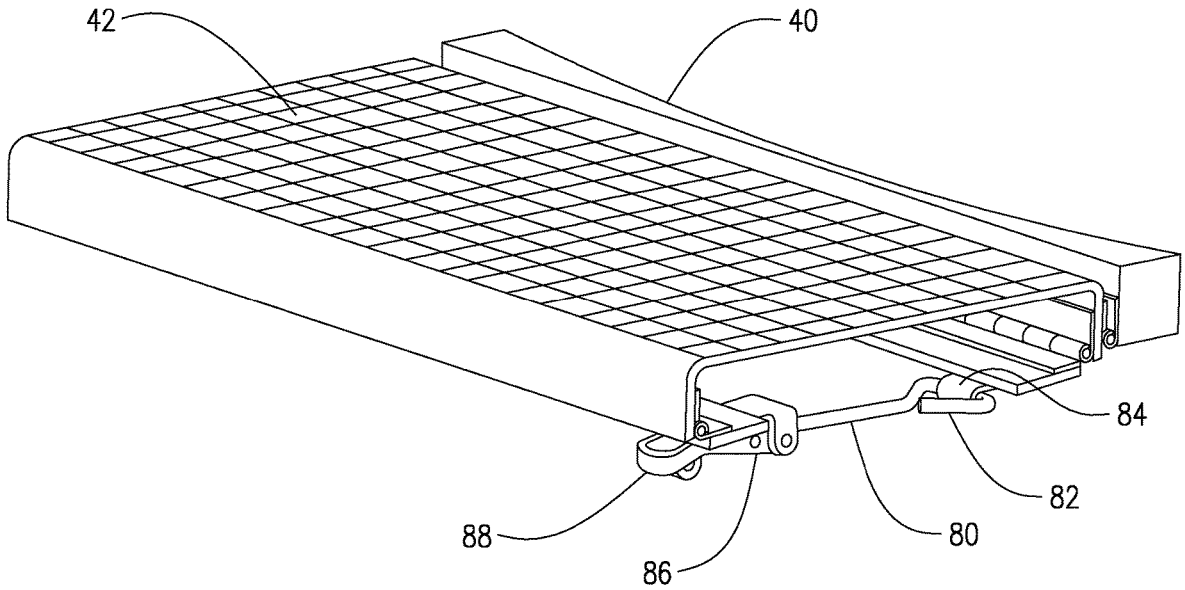
Figure 15:
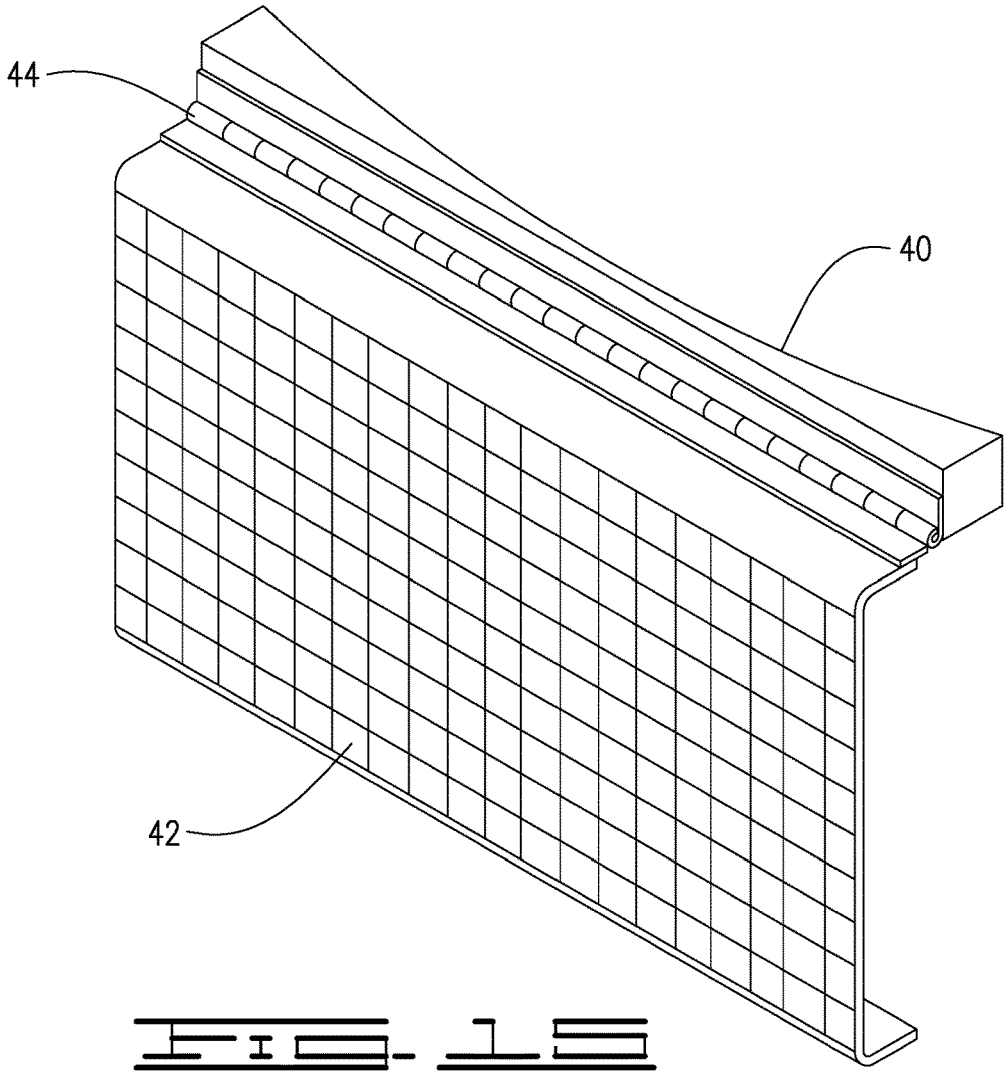
FIG. 15 depicts a step plate in the downward position as when the ladder stabilizer is in a stored position.
Figure 15A:
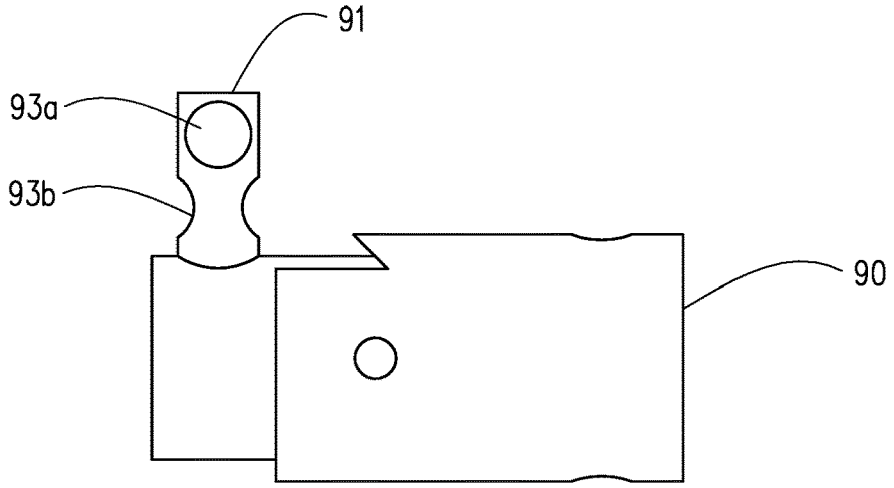

One example of a mechanism for securing step plate 42 to ladder rung or step 7 is depicted in FIGS. 13 and 14. As depicted in FIGS. 13 and 14, latching mechanism 80 includes a first end 82 which engages a hook or loop 84 carried by step plate 42. Additionally, latching mechanism 80 will typically include a locking or securing mechanism 86 at second end 88. While several latching mechanisms will be suitable, an i-bolt bailing latch or toggle latch as depicted in FIGS. 13 and 14 is particularly useful for securing step plate 42 to ladder rung 7.

To permit use of ladder stabilizer 10 with a wide variety of ladders, each extension arm 20, 30 carries a height adjustable leg 50, 60. Each height adjustable leg 50, 60 has a series of holes 58, 68 passing through each leg. Holes 58, 68 are located near first ends 52, 62 of each leg 50, 60. Thus, legs 50 and 60 are adjustable in height to accommodate different types of ladders 5. Additionally, the independent adjustment of legs 50, 60 accommodates uneven surfaces. Typically, legs 50 and 60 may be adjusted in increments of 1 inch to five inches by removal and replacement of pins 70.

In one embodiment, the diameter of first and second legs 50, 60 may range between about 0.75" to about 1" with lengths ranging between about 20 inches and about 35 inches. Legs 50 and 60 are preferably sized to pass through receivers 26, 36. As discussed above with regard to retaining extension arms 20, 30 in the desired location, the retention of each leg 50, 60 at the desired height may alternatively be achieved with spring biased locking buttons carried by each leg 50, 60 at locations corresponding to holes 58, 68. Thus, with legs 50, 60 positioned at the desired height, locking buttons extend through holes 28, 38 located in receivers 26, 36 respectively. Thus, retention configurations suitable for securing ladder stabilizer 10 at the desired height include but are not limited to pins 70, which may be in the shape of a t-handle pin, cotter pins, spring biased buttons or other similar device which pass through holes 58, 68 and 28, 38 thereby engaging legs 50, 60 and receivers 26, 36 as depicted in FIGS. 6-8

With reference to first extension arm 20, in one embodiment, a first receiver 26 is secured to second end 24 of first extension arm 20. First receiver 26 is sized to receive first end 52 of first leg 50. In one embodiment, first receiver 26 permits rotational movement of leg 50 from the stored position shown in FIG. 3 to the deployed configuration shown in FIGS. 7 and 8.

In another embodiment a separate suitable pivoting mechanism is used in connection with receivers 26, 36 as depicted in FIGS. 6, 16, 18-19 and 21. Pivoting joint 90 includes as an integral component receiver 26, 36 or supports receivers 26, 36 as separate but attached components. Pivoting joint 90 also provides for movement of legs 50, 60 from the stored position of FIGS. 2 and 3 to the deployed position of FIGS. 7 and 8. Typically, legs 50 and 60 are preferably sized to pass through receivers 26, 36 when pivoting joint 90 is aligned in the deployed position, i.e. pivoting joint 90 aligns with the vertical plane B of the deployed position.

Figure 16B:
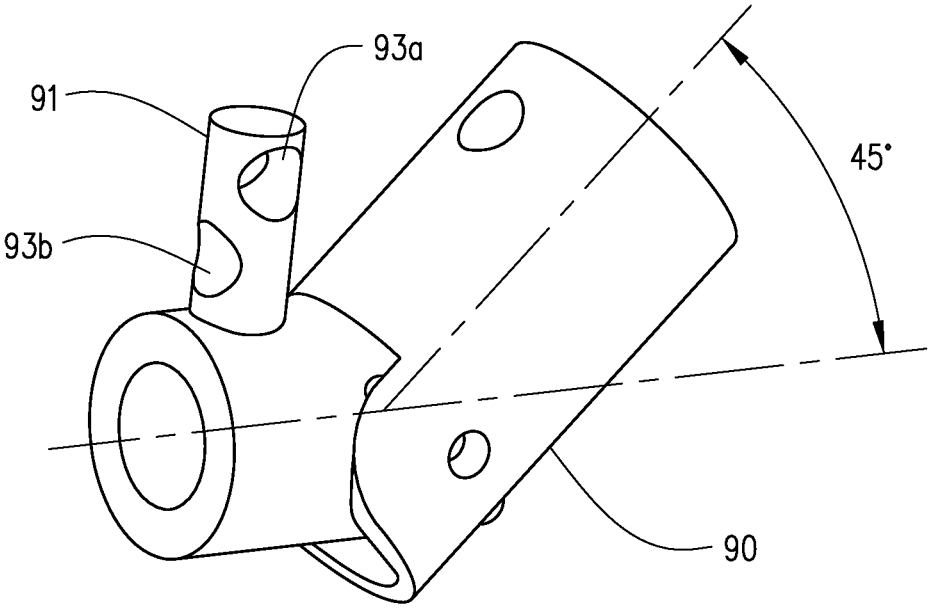

As depicted in FIGS. 16A and 16B, pivoting joint 90 includes a tang 91 which can be placed within second ends 24, 34 of extension arms 20, 30. Thus, tang 91 is rotatably received within extension arm 20, 30. Tang 91 may have one hole 93 or a pair of holes 93*a*, 93*b*. To secure pivoting joint 90 in deployed position after rotating of tang 91, a retaining pin 70 or other conventional device passes through holes 29 in second end 24 and holes 39 in second end 34 and through the desired hole 93 of tang 91 or 93*a,b* depending on configuration. Removal of pin 70 and rotation of joint 90 to the stored position followed by replacement of pin 70 passing through one of holes 93, 93*a*, 93*b* and holes 29, 39 secures pivoting joint 90 in the deployed position. As an alternative to securing pivoting joint 90 in the stored position with pin 70, legs 50, 60 may engage one another thereby retaining both legs in the stored position. When in the stored positions with legs 50, 60 substantially parallel to one another, legs 50, 60 define a horizontal plane C. When in the fully deployed position, legs 50, 60 each define a vertical plane B.

Pivoting joint 90 has sufficient resistance to retain the desired position, i.e. deployed or stored. Following rotation of pivoting joint 90 on tang 91 to the stored horizontal plane C position, the configuration of pivoting joint 90 retains pivoting joint 90 at an angle relative to a receiver 26, 36, referred to as the stored angle. The stored angle is selected to allow each leg 50, 60 to be adjacent to one another in the stored position. See FIG. 2. Typically, the angle relative to receiver 26, 36 will be about 45°; however, this angle may vary depending on the size of stabilizer 10 and degrees of arc defined by stabilizer 10 when fully stored. Pivoting of pivoting joint 90 from the stored position to the partially deployed/partially stored position, i.e. each leg remains in the horizontal plane C, and back to the fully stored position requires application of sufficient force to legs 50, 60 to allow legs 50, 60 to move from the stored angle position relative to receivers 26, 36 to a position where legs 50, 60 are aligned with receivers 26, 36. See FIGS. 21-23. Thus, when fully deployed receiver 26, leg 50 and the associated pivoting joint 90 define a vertical plane B. Likewise, when fully deployed receiver 36, leg 60 and the associated pivoting joint 90 define a vertical plane B. Both legs 50, 60 may be in the same vertical plane B.

Figure 22:
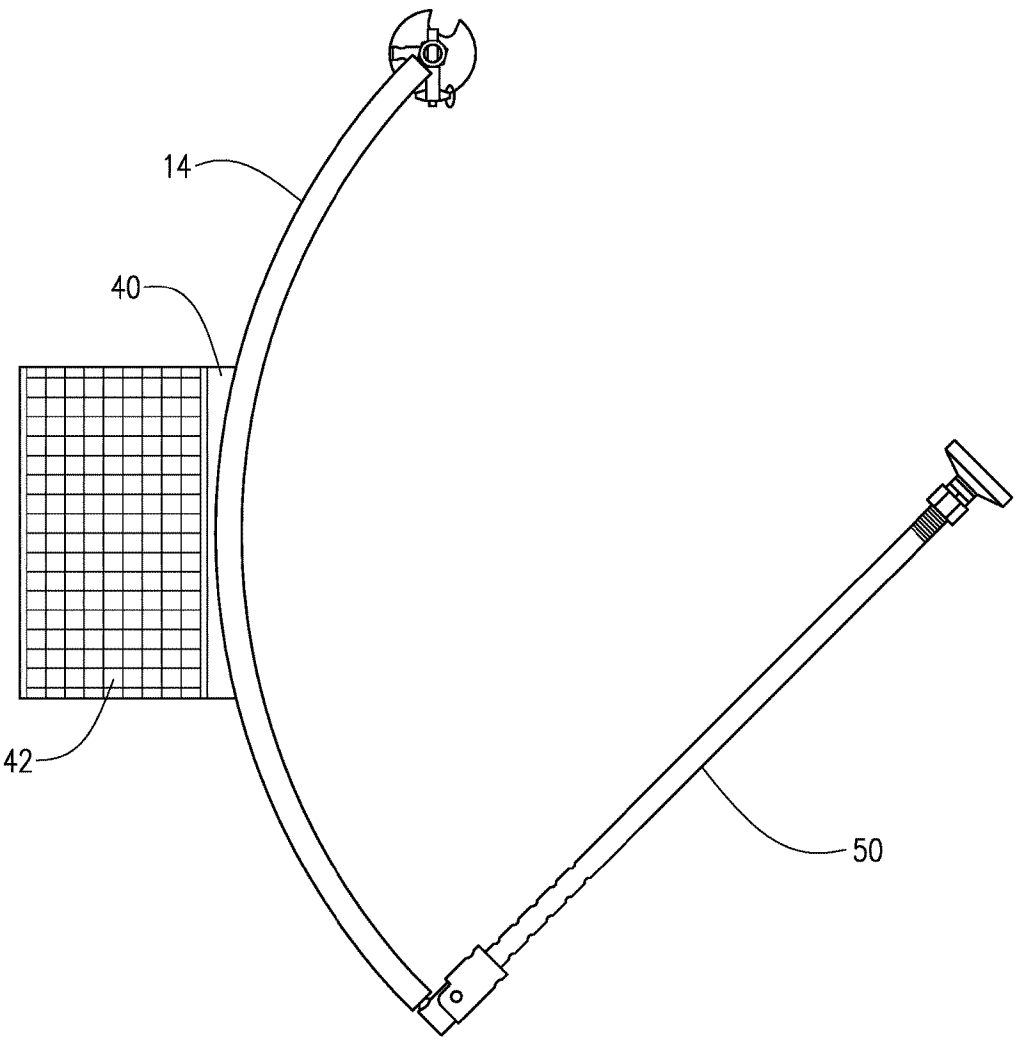
FIG. 22 depicts the pivoting joint of FIGS. 16A and 16B as installed on the ladder stabilizer with one leg in the partially deployed/stored position but rotated to a position ready for rotation of the leg from the horizontal plane to the vertical plane.
Figure 21:
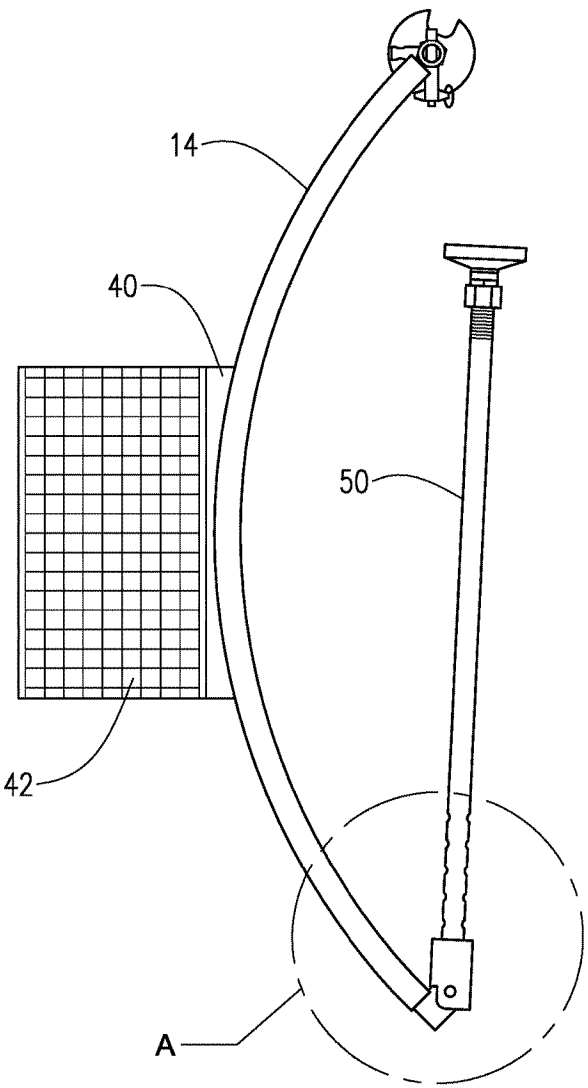
FIG. 21 depicts the pivoting joint of FIGS. 16A and 16B as installed on the ladder stabilizer with one pivoting joint in the stored position and one in the deployed position.
Figure 24:
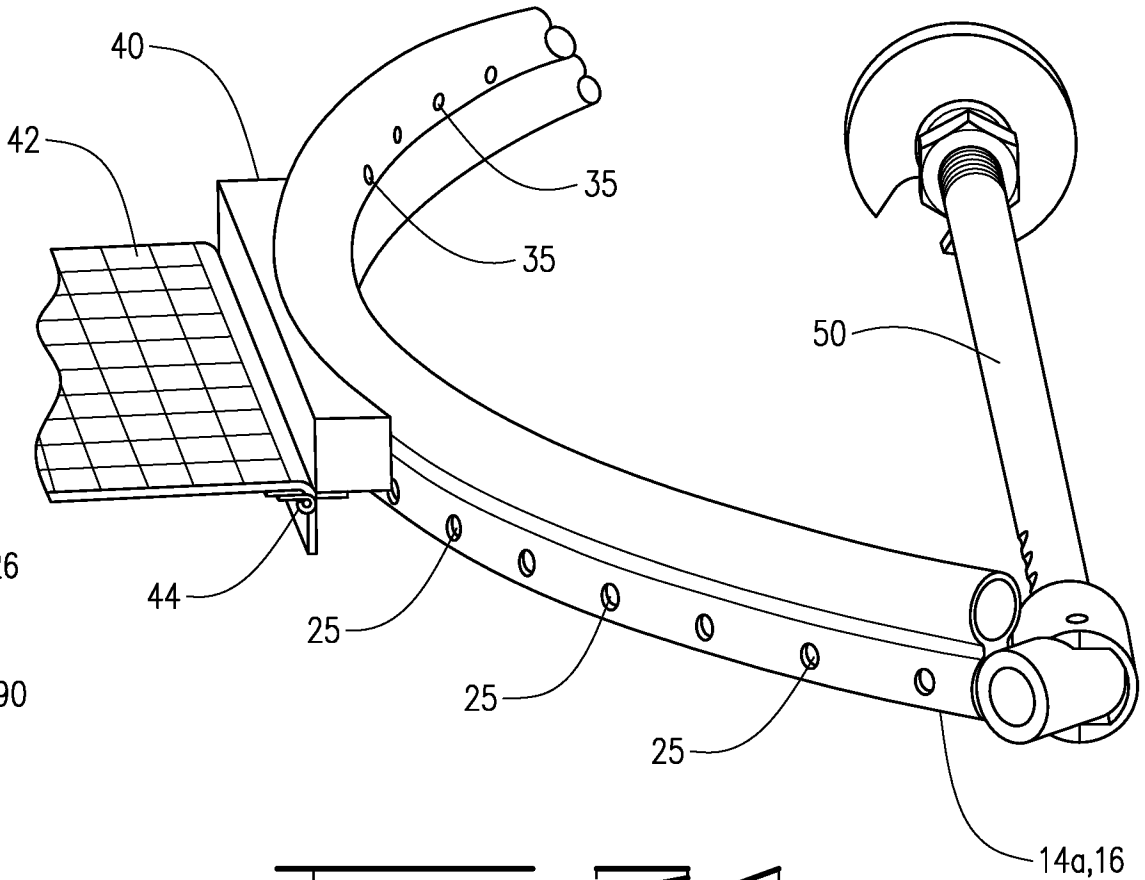
FIG. 24 depicts one pivoting joint in the stored position and the opposing leg in the deployed position but with the extension arm retracted.
Figure 25:
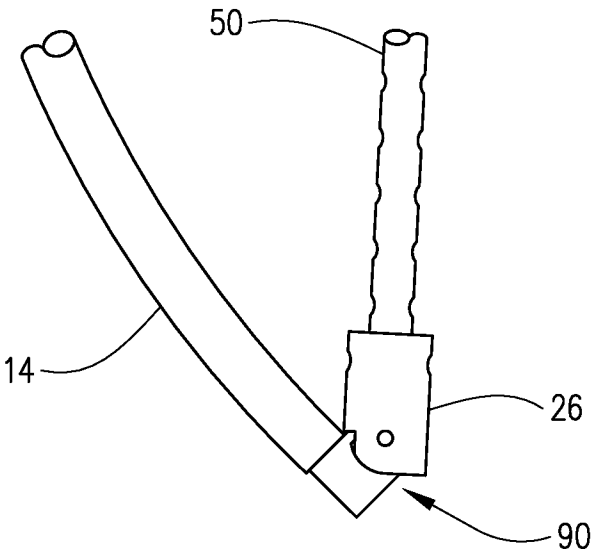
FIG. 25 depicts the relative planes corresponding to the stored and deployed positions of the legs.
Figure 25:
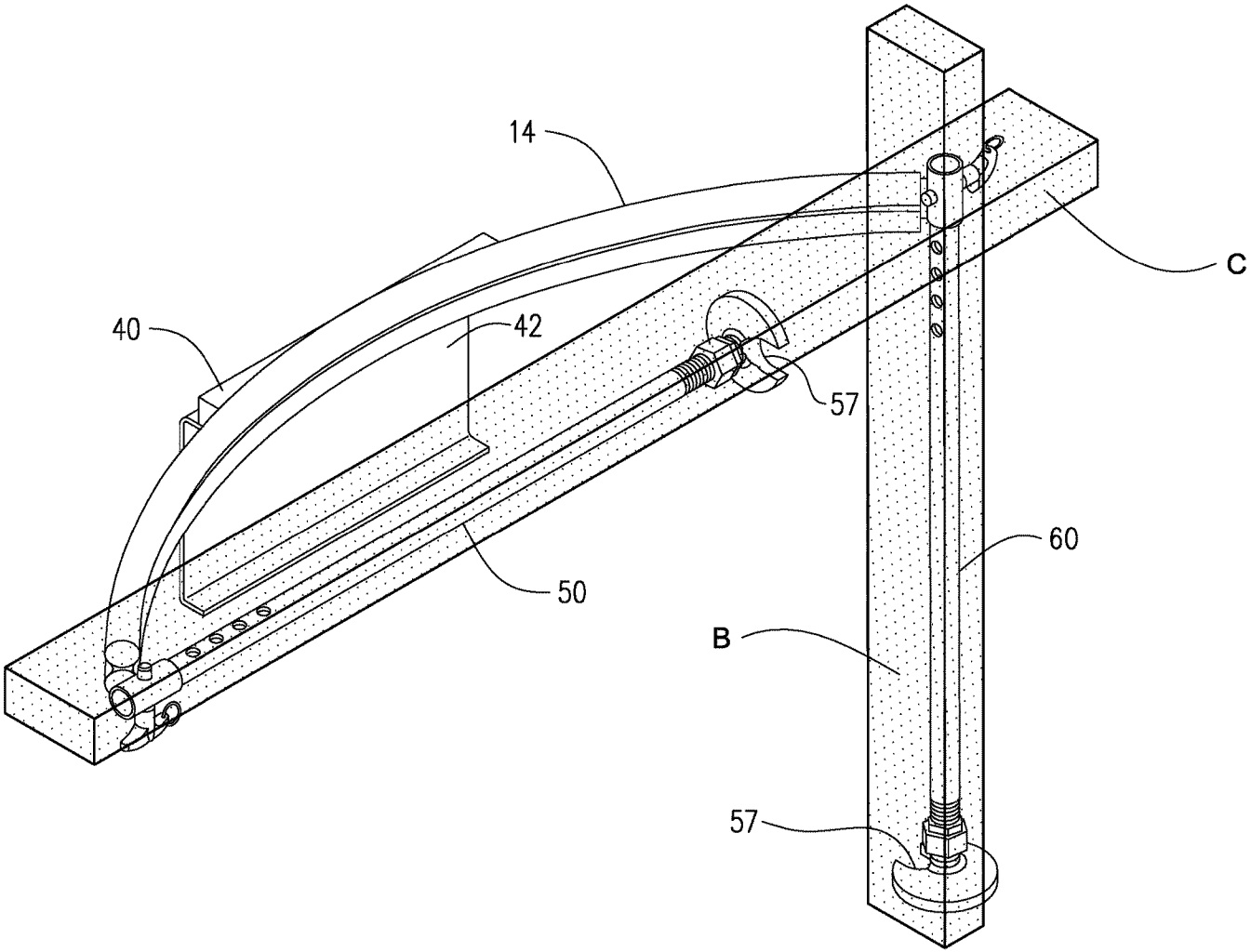
Figure 2E:
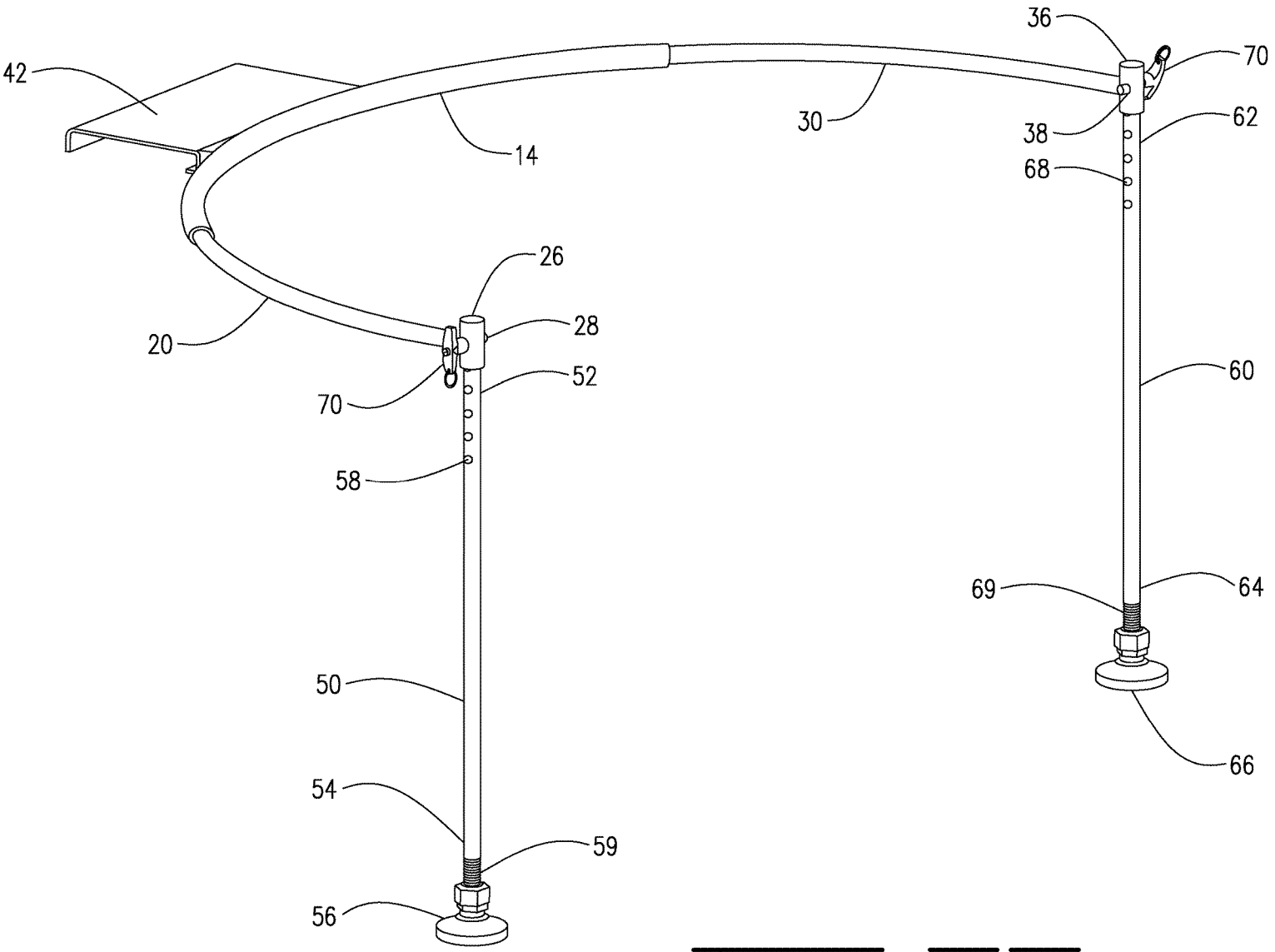

Receiver 26, 36 is generally a hollow body with at least one pair of opposed holes 28, 38 on each side of the hollow body. As noted above, when using pivoting joint 90, receivers 26, 36 may be integral with pivoting joint 90 as depicted in FIGS. 21-23. Note: either portion of pivoting joint 90 may define receiver 26, 36. Thus, the portion of pivoting joint 90 carrying tang 91 may be extended sufficiently to also act as a receiver. In either case, pivoting joint 90 will typically have an interior diameter sufficient to allow for passage of legs 50, 60 completely through pivoting joint 90. Thus, with first end 52 of leg 50 positioned within first receiver 26 and with one of holes 58 aligned with opposed holes 28, a pin 70 passing therethrough will secure leg 50 to first receiver 26 at a selected height. The foregoing description assumes that legs 50 and 60 are solid rods; however, hollow rods or tubes will perform satisfactorily. When using hollow rods or tubes, holes 58 in leg 50 will also be pairs of opposed holes. The securement of leg 60 to extension arm 30 corresponds to the foregoing discussion. Thus, first end 62 of leg 60 is placed within second receiver 36 and secured at the desired height by a pin 70 passing through a pair of opposed holes 38 in pivoting receiver 36 and a corresponding hole 68 passing through leg 60. See FIGS. 7 and 19.

Figure 11:
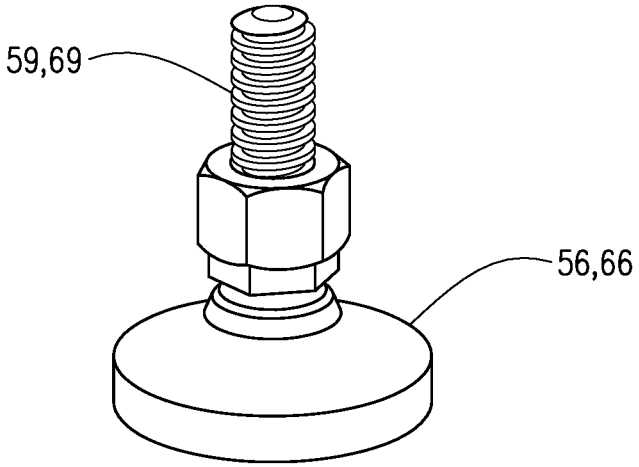
FIG. 11 is a perspective view of one embodiment of a foot suitable for attachment to the bottom of each leg.
Figure 12:
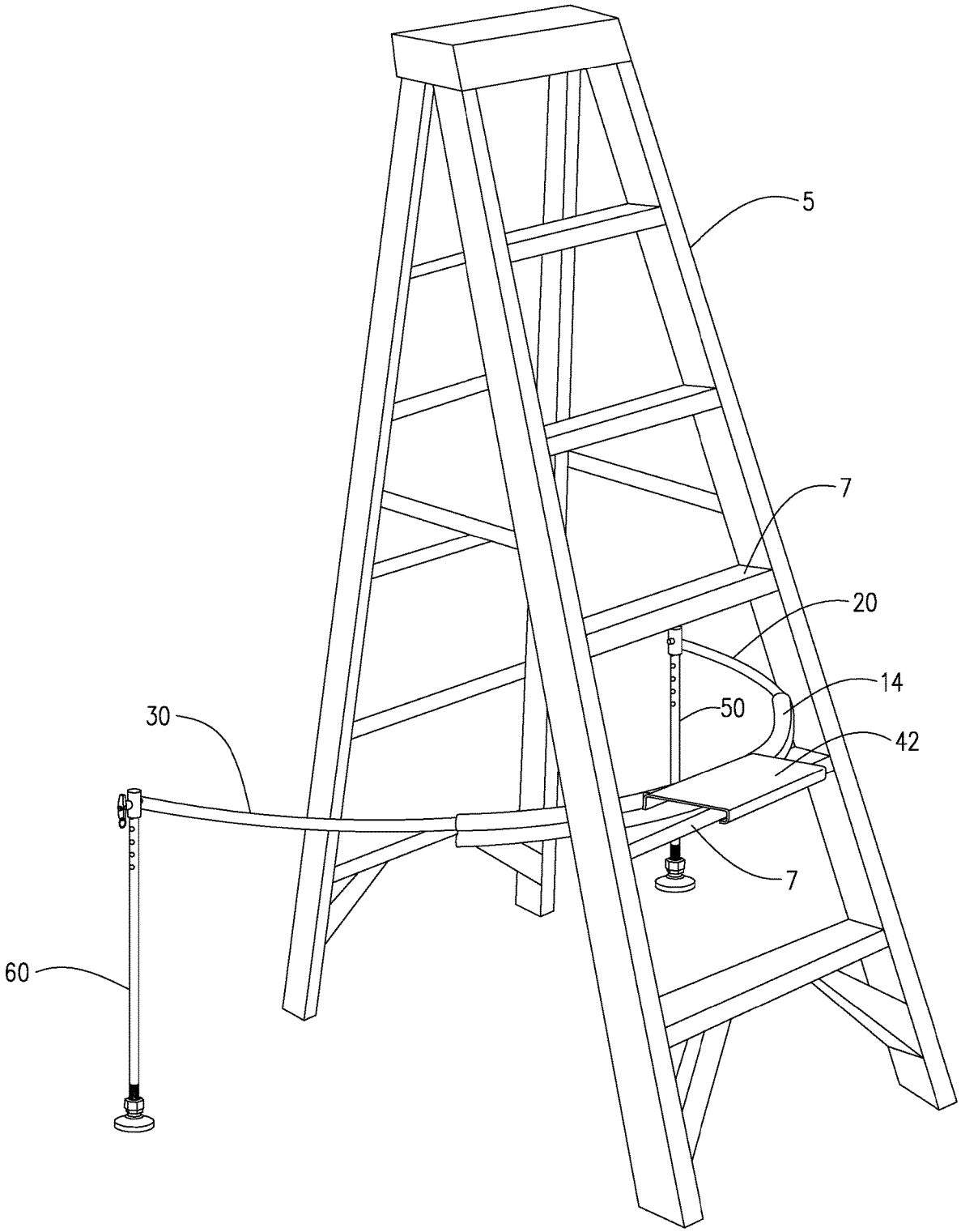
FIG. 12 is a perspective view of the stabilizer installed on a step ladder.

Each leg 50, 60 terminates in a foot 56, 66. As depicted in FIG. 11, foot 56, 66 may be of a ball and socket type configuration thereby allowing foot 56, 66 a degree of free movement, i.e. pivotable or flex movement, to accommodate uneven surfaces. Additionally, each foot may provide for further height adjustment of each leg 50, 60 by a threaded connection 59, 69 between foot 56, 66 and legs 50, 60. However, each foot may be of other configurations.

Figure 3:
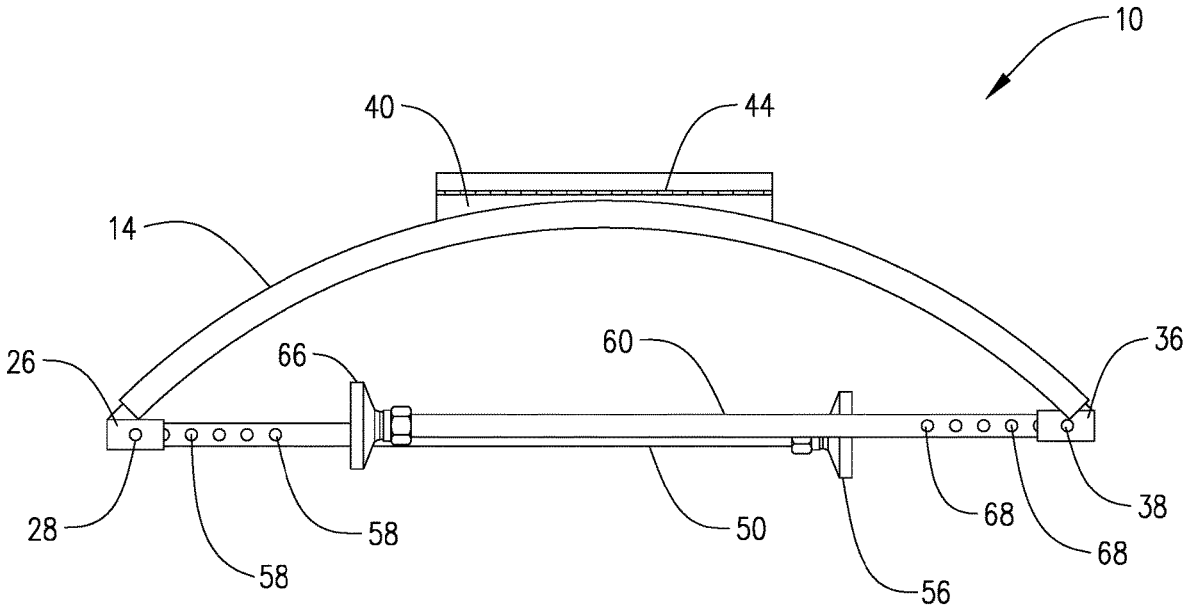
FIG. 3 is a top view of the ladder stabilizer in a collapsed configuration.
Figure 17:
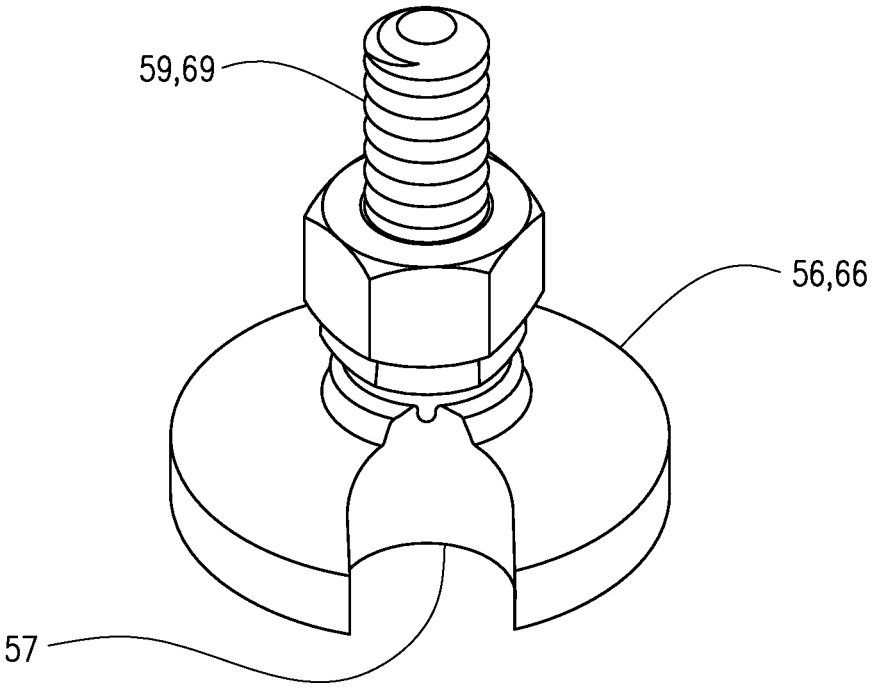
FIG. 17 depicts one embodiment of the foot carried at the end of each leg of the stabilizer.
Figure 12:
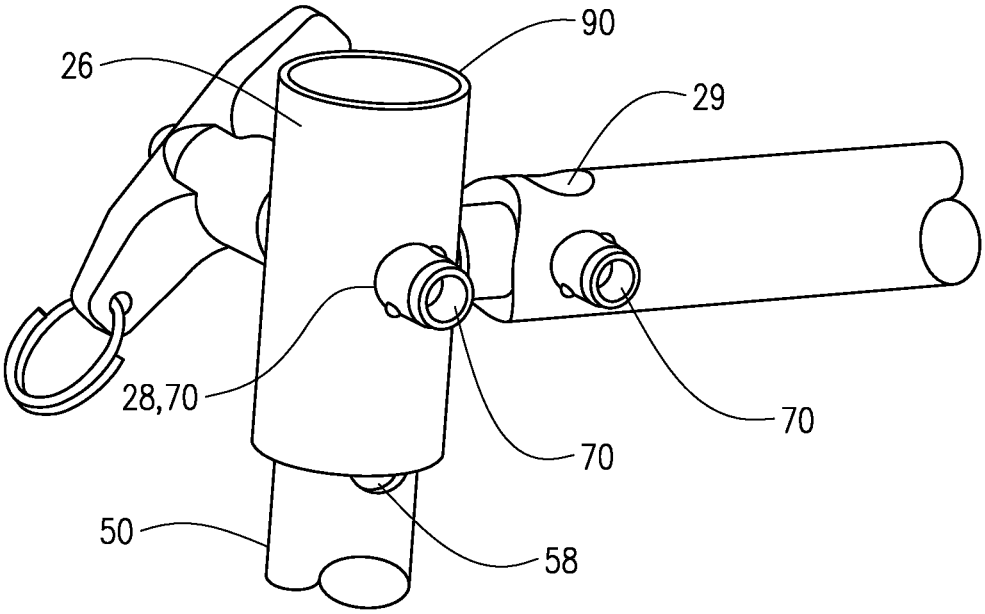
Figure 13:
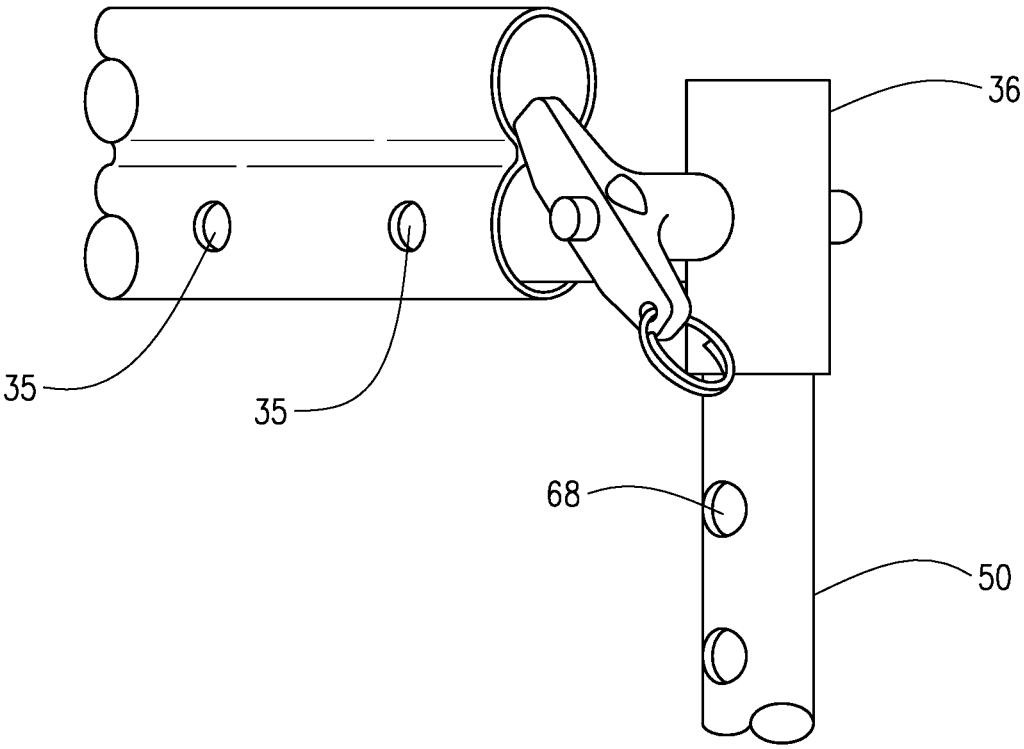
Figure 20A:
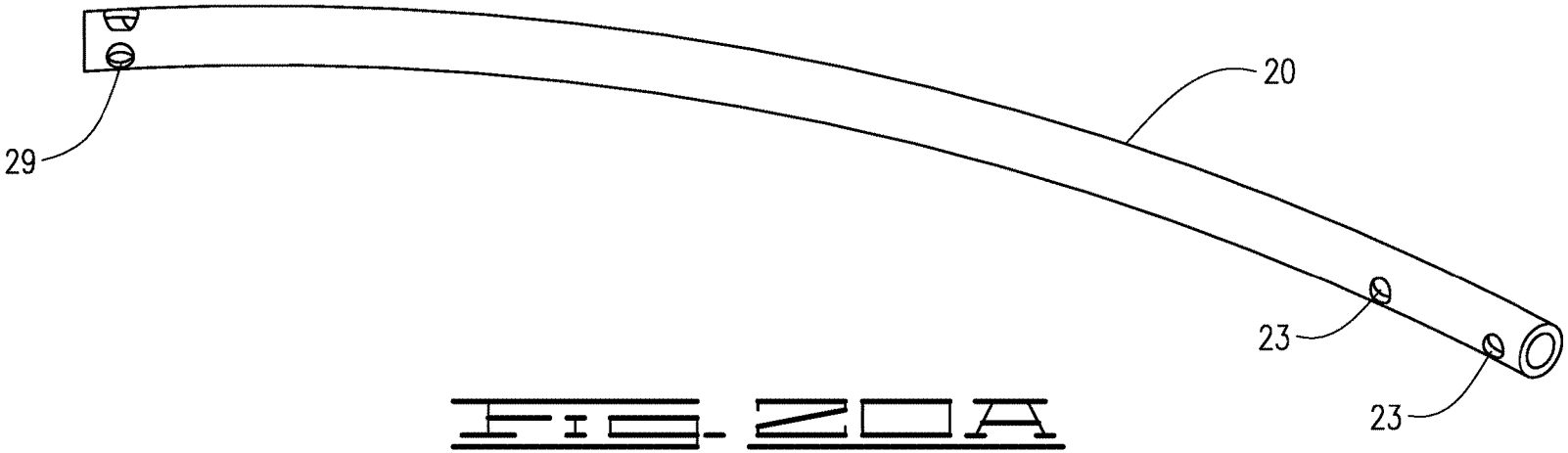
FIGS. 20A and 20B depict left and right extension arms.
Figure 20B:
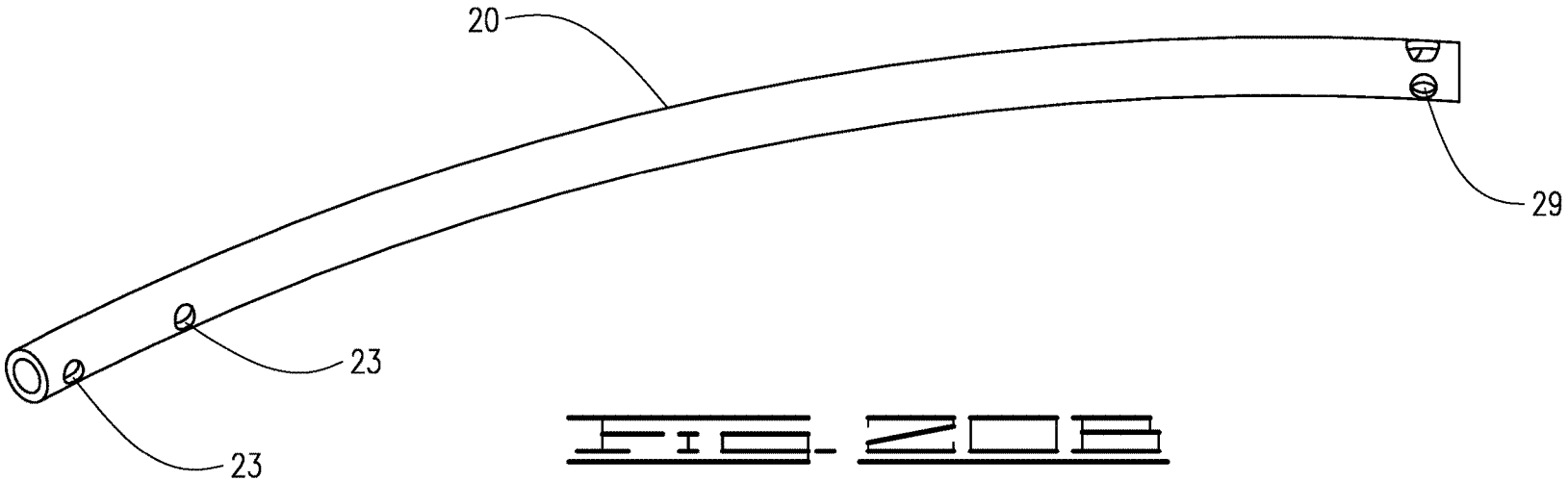

As depicted in FIG. 17, each foot 56, 66 may have a recess 57 to permit better storage of legs 50, 60 in the stored position depicted in FIGS. 2 and 3. Thus, when in the horizontal plane C corresponding to the stored position, each foot 56, 66 may engage the opposing leg 60, 50 providing a more compact storage configuration while also retaining legs 50, 60 adjacent to one another. In one embodiment, recess 57 is sized to receive opposing leg 50, 60 and provide a friction fit with the opposing leg for enhanced retention thereby frictionally securing one leg 50, 60 to the other. In another embodiment, each foot 56, 66 is made from a compliant material. Any convenient thermoplastic or thermosetting polymer or rubber which deflects sufficiently when molded into the shape of foot 56, 66 will perform adequately in this configuration. Thus, the radius of recess 57 may be slightly smaller than the outer diameter of legs 50, 60. Optionally, a strap may also be used to secure legs 50, 60 in the horizontal plane C.

Figure 10:
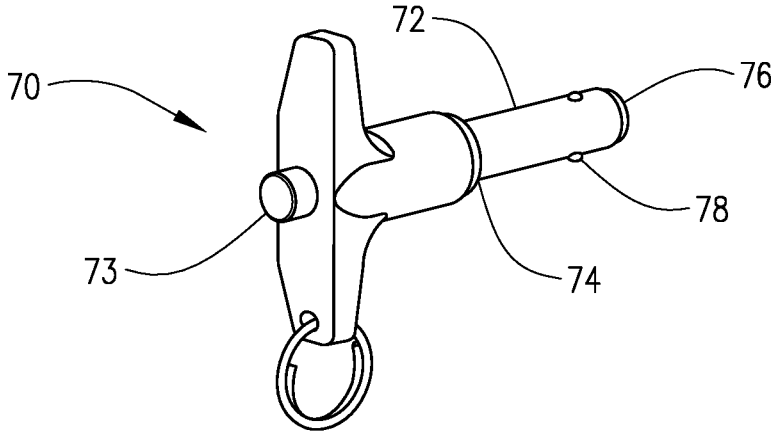
FIG. 10 is a perspective view of a retaining pin.

In one embodiment, as depicted in FIG. 10, pin 70 is configured to preclude an inadvertent loss of engagement. In this embodiment, pin 70 has a body 72, a first end 74, a second end 76, at least one hole 77 retaining a spring biased ball 78 and a biasing spring, not shown, within body 72. The biasing spring applies pressure, directly or indirectly, to ball 78 thereby forcing ball 78 outward against the edges of hole 77. To relieve pressure against ball 78 and permit removal of pin 70 from holes 28, 58, application of pressure against a button 73 within handle 71 compresses the biasing spring and allows ball 78 to at least partially drop back into body 72.

To further explain the nature of ladder stabilizer 10, FIGS. 1-3 depict ladder stabilizer in a collapsed position. In FIGS. 1-3, step plate 42 projects downward and extension arms 20, 30 are fully stored within hollow tubes 14*a*, 14*b*. Additionally, pivoting receivers 26, 36 have been rotated such that legs 50, 60 are now in substantially the same plane defined by rigid lateral support 12. In the collapsed position, legs 50, 60 are typically set to their highest position thereby precluding ends 52, 62 from projecting outward from pivoting receivers 26, 36.

FIGS. 4-8 depict the transition from the collapsed position to the fully deployed position. The steps for deploying ladder stabilizer 10 may be carried out in almost any order. The following is merely exemplary of one possible method. To set up ladder stabilizer 10 for use, one will move step plate 42 to an outwardly projecting position, i.e. horizontal or parallel to the ground, as depicted in FIGS. 4-5 and 7-8. Additionally, each leg 50, 60 will be rotated by turning pivoting receivers 26 and 36 from the collapsed position to a position which is 90° to the plane defined by rigid lateral support 12. If rung 7 of ladder 5 is at a height different from the height of deployed ladder stabilizer, then pin 70 can be removed and the height of each leg adjusted as needed to place step plate 42 in contact with rung 7.

Other embodiments of the present invention will be apparent to one skilled in the art. As such, the foregoing description merely enables and describes the general uses and methods of the present invention. Accordingly, the following claims define the true scope of the present invention.

What is claimed is:

1. A ladder stabilizer comprising:

a rigid lateral support, said lateral support formed from at least one hollow tube, said hollow tube having a first end and a second end, the hollow tube defines an arc running from the first end to the second end;

a first extension arm having a first end and a second end, said first extension arm first end positioned within said first end of said hollow tube;

a second extension arm having a first end and a second end, said second extension arm first end positioned within said second end of said hollow tube;

a support beam secured to said rigid lateral support said support beam has a first side and a second side, said rigid lateral support secured to said first side of the support beam;

a step plate secured by a hinge to said second side of the support beam the step plate having an upper flat surface configured to extend over an upper surface of a ladder step;

a first leg having a first end and a second end, said first end of said first leg pivotally secured to said first extension arm;

a second leg having a first end and a second end, said first end of said second leg pivotally secured to said second extension arm.

2. The ladder stabilizer of claim 1, wherein said rigid lateral support comprises a first hollow tube, the first hollow tube having a length, and a second hollow tube, the second hollow tube having a length, wherein each hollow tube is secured to said support beam.

3. The ladder stabilizer of claim 2, wherein said first extension arm is positioned in said first hollow tube and said second extension arm is positioned in said second hollow tube and wherein said first extension arm has a length equal to at least 30% of the length of said first hollow tube and said second extension arm has a length equal to at least 30% of the length of said second hollow tube.

4. The ladder stabilizer of claim 3, wherein said first extension arm has a length equal to at least half the length of said first hollow tube and said second extension arm has a length equal to at least half the length of said second hollow tube.

5. The ladder stabilizer of claim 1, wherein said hinge allows said step plate to move through a 90° range of motion with said step plate aligned in a vertical position when in a collapsed position and aligned in a horizontal position when configured to engage a step of the ladder.

6. The ladder stabilizer of claim 1, wherein said second end of said first extension arm carries a first pivoting receiver configured to receive the said first end of said first leg, said pivoting receiver allows the first leg to pivot to a position which is 90° to a plane defined by said rigid lateral support and said second end of said second extension arm carries a second pivoting receiver configured to receive the said first end of said second leg, said pivoting receiver allows the second leg to pivot to a position which is 90° to a plane defined by said rigid lateral support.

7. The ladder stabilizer of claim 6, wherein said first pivoting receiver has a pair of opposed holes passing through the first pivoting receiver and wherein the first end of said first leg has a series of holes passing through said first end of said first leg such that when a hole in said first end of said first leg is aligned with said pair of opposed holes in said first pivoting receiver a pin passing through the aligned holes will retain said first leg to said first pivoting receiver at a fixed height and wherein said second pivoting receiver has a pair of opposed holes passing through the second pivoting receiver and wherein the first end of said second leg has a series of holes passing through said first end of said second leg such that when a hole in said first end of said second leg is aligned with said pair of opposed holes in said second pivoting receiver a pin passing through the aligned holes will retain said second leg to said second pivoting receiver at a fixed height.

8. The ladder stabilizer of claim 1, further comprising:

a first height adjustable foot secured to said second end of said first leg; and, a second height adjustable foot secured to said second end of said second leg.

9. The ladder stabilizer of claim 8, wherein each height adjustable foot has a recess.

10. A ladder stabilizer comprising:

a rigid lateral support, said lateral support formed from at least one curved hollow tube, said curved hollow tube having a first end and a second end, the hollow tube defines an arc running from the first end to the second end;

a first extension arm having a first end and a second end, said first extension arm first end positioned within said first end of said curved hollow tube;

a second extension arm having a first end and a second end, said second extension arm first end positioned within said second end of said curved hollow tube;

a support beam secured to said rigid lateral support;

a step plate secured by a hinge to said support beam;

a first leg having a first end and a second end, said first end of said first leg pivotally secured to said first extension arm and said first end of said first leg being height adjustable, said second end of said first leg terminating in a height adjustable and pivotal foot;

a second leg having a first end and a second end, said first end of said second leg pivotally secured to said second extension arm and said first end of said second leg being height adjustable, said second end of said second leg terminating in a height adjustable and pivotal foot.

11. The ladder stabilizer of claim 10, wherein said rigid lateral support comprises a first curved hollow tube having a first end and a second end and a second curved hollow tube having a first end and a second end wherein each curved hollow tube is secured to said support beam, the first curved hollow tube defines an arc running from the first end to the second end and the second hollow tube defines an arc running from the first end to the second end.

12. The ladder stabilizer of claim 11, wherein said first extension arm is positioned in said first curved hollow tube, the first hollow tube having a length, and said second extension arm is positioned in said second curved hollow tube, the second hollow tube having a length.

13. The ladder stabilizer of claim 12, wherein said first extension arm has a length equal to at least half the length of said first curved hollow tube and said second extension arm has a length equal to at least half the length of said second curved hollow tube.

14. The ladder stabilizer of claim 10, wherein said support beam has a first side and a second side, said first side has a radius of curvature which conforms to a radius of curvature of said at least one curved hollow tube and said second side is substantially straight.

15. The ladder stabilizer of claim 10, wherein said hinge allows said step plate to move through a 90° range of motion with said step plate aligned in a vertical position when in a collapsed position and aligned in a horizontal position when configured to engage a step of the ladder.

16. The ladder stabilizer of claim 10, where said second end of said first extension arm carries a first pivoting receiver configured to receive the said first end of said first leg, said pivoting receiver allows the first leg to pivot to a position which is 90° to a plane defined by said rigid lateral support and said second end of said second extension arm carries a second pivoting receiver configured to receive the said first end of said second leg, said pivoting receiver allows the second leg to pivot to a position which is 90° to a plane defined by said rigid lateral support.

17. The ladder stabilizer of claim 16, wherein said first pivoting receiver has a pair of opposed holes passing through the first pivoting receiver and wherein the first end of said first leg has a series of holes passing through said first end of said first leg such that when a hole in said first end of said first leg is aligned with said pair of opposed holes in said first pivoting receiver a pin passing through said aligned holes will retain said first leg to said first pivoting receiver at a fixed height and wherein said second pivoting receiver has a pair of opposed holes passing through the second pivoting receiver and wherein the first end of said second leg has a series of holes passing through said first end of said second leg such that when a hole in said first end of said second leg is aligned with said pair of opposed holes in said second pivoting receiver a pin passing through the aligned holes will retain said second leg to said second pivoting receiver at a fixed height.

18. A ladder comprising:

at least one pair of legs, at least two rungs positioned between and connecting said pair of legs to one another;

a ladder stabilizer secured to at least one of said rungs, said ladder stabilizer comprising:

a rigid lateral support, said lateral support formed from at least one hollow tube, said hollow tube having a first end and a second end and the hollow tube having a length, the hollow tube defines an arc running from the first end to the second end;

a first extension arm having a first end and a second end, said first extension arm first end positioned within said first end of said hollow tube, said first extension arm having length equal to at least one third the length of said hollow tube;

a second extension arm having a first end and a second end, said second extension arm first end positioned within said second end of said hollow tube, said second extension arm having length greater than one half the length of said hollow tube;

a support beam secured to said rigid lateral support said support beam has a first side and a second side, said rigid lateral support secured to said first side of the support beam;

a step plate secured by a hinge to said support beam the step plate having an upper flat surface configured to extend over an upper surface of one of the rungs;

a first leg having a first end and a second end, said first end of said first leg pivotally secured to said first extension arm, said second end of said first leg terminating in a foot;

a second leg having a first end and a second end, said first end of said second leg pivotally secured to said second extension arm, said second end of said second leg terminating in a foot.

19. The ladder of claim 18, wherein said rigid lateral support comprises a first hollow tube and a second hollow tube wherein each hollow tube is secured to said support beam.

20. The ladder of claim 19, wherein said first extension arm is positioned in said first hollow tube, the first hollow tube having a length, and said second extension arm is positioned in said second hollow tube, the second hollow tube having a length.

21. The ladder of claim 20, wherein said first extension arm has a length equal to at least half the length of said first hollow tube and said second extension arm has a length equal to at least half the length of said second hollow tube.

22. The ladder of claim 18, wherein said hinge allows said step plate to move through a 90° range of motion with said step plate aligned in a vertical position when in a collapsed position and aligned in a horizontal position when configured to engage a step of the ladder.

23. The ladder of claim 18, wherein said second end of said first extension arm carries a first pivoting receiver configured to receive the said first end of said first leg, said pivoting receiver allows the first leg to pivot to a position which is 90° to a plane defined by said rigid lateral support and said second end of said second extension arm carries a second pivoting receiver configured to receive the said first end of said second leg, said pivoting receiver allows the second leg to pivot to a position which is 90° to a plane defined by said rigid lateral support.

24. The ladder of claim 23, wherein said first pivoting receiver has a pair of opposed holes passing through the first pivoting receiver and wherein the first end of said first leg has a series of holes passing through said first end of said first leg such that when a hole in said first end of said first leg is aligned with said pair of opposed holes in said first pivoting receiver a pin passing through the aligned holes will retain said first leg to said first pivoting receiver at a fixed height and wherein said second pivoting receiver has a pair of opposed holes passing through the second pivoting receiver and wherein the first end of said second leg has a series of holes passing through said first end of said second leg such that when a hole in said first end of said second leg is aligned with said pair of opposed holes in said second pivoting receiver a pin passing through the aligned holes will retain said second leg to said second pivoting receiver at a fixed height.

25. The ladder of claim 24, wherein said pin has a body with a first end and second end and a spring centrally located within said body, said spring biases at least one ball located proximate to said second end of said pin in an outward position such that at least a portion of said ball extends beyond said body, and said pin has a release button located in said first end of said pin such that compression of said release button compresses said spring allowing for said ball to drop a distance into said pin body.

26. The ladder of claim 18, wherein said rigid lateral support is formed from at least one curved hollow tube and said support beam has a first side and a second side, said first side has a radius of curvature which conforms to a radius of curvature of said at least one curved hollow tube and said second side is substantially straight.

27. The ladder of claim 18, wherein said rigid lateral support comprises a first curved hollow tube and a second curved hollow tube wherein each curved hollow tube is secured to said support beam and said support beam has a first side and a second side, said first side has a radius of curvature which conforms to a radius of curvature of at least one curved hollow tube and said second side is substantially straight.

28. A ladder stabilizer comprising:

a rigid lateral support, said lateral support formed from at least one hollow tube, said hollow tube having a first end and a second end;

a first extension arm having a first end and a second end, said first extension arm first end positioned within said first end of said hollow tube;

a second extension arm having a first end and a second end, said second extension arm first end positioned within said second end of said hollow tube;

a support beam secured to said rigid lateral support said support beam has a first side and a second side, said rigid lateral support secured to said first side of the support beam;

a step plate secured by a hinge to said second side of the support beam;

a first leg having a first end and a second end, said first end of said first leg pivotally secured to said first extension arm by a first pivotal connection, said first pivotal connection allows the first leg to pivot along a vertical plane and along a horizontal plane;

a second leg having a first end and a second end, said first end of said second leg pivotally secured to said second extension arm by a second pivotal connection, said second pivotal connection allows the first leg to pivot along a vertical plane and along a horizontal plane.

29. The ladder stabilizer of claim 28, wherein said rigid lateral support comprises a first hollow tube, the first hollow tube having a length, and a second hollow tube, the second hollow tube having a length, wherein each hollow tube is secured to said support beam.

30. The ladder stabilizer of claim 29, wherein said first extension arm is positioned in said first hollow tube and said second extension arm is positioned in said second hollow tube and wherein said first extension arm has a length equal to at least 30% of the length of said first hollow tube and said second extension arm has a length equal to at least 30% of the length of said second hollow tube.

31. The ladder stabilizer of claim 30, wherein said first extension arm has a length equal to at least half the length of said first hollow tube and said second extension arm has a length equal to at least half the length of said second hollow tube.

32. A ladder stabilizer comprising:

a rigid lateral support, said lateral support formed from a first curved hollow tube and a second curved hollow tube, said first curved hollow tube having a first end and a second end, said second curved hollow tube having a first end and a second end;

the first hollow tube defines an arc running from the first end to the second end, the first hollow tube having a length and the first hollow tube is curved along the length of the first hollow tube;

the second hollow tube defines an arc running from the first end to the second end the second hollow tube having a length and the second hollow tube is curved along the length of the second hollow tube;

a first extension arm having a first end and a second end, said first extension arm first end positioned within said first end of said curved hollow tube;

a second extension arm having a first end and a second end, said second extension arm first end positioned within said second end of said curved hollow tube;

a support beam secured to said rigid lateral support;

a step plate secured by a hinge to said support beam;

a first leg having a first end and a second end, said first end of said first leg pivotally secured to said first extension arm and said first end of said first leg being height adjustable, said second end of said first leg terminating in a height adjustable and pivotal foot;

a second leg having a first end and a second end, said first end of said second leg pivotally secured to said second extension arm and said first end of said second leg being height adjustable, said second end of said second leg terminating in a height adjustable and pivotal foot.

33. The ladder stabilizer of claim 32, wherein said first extension arm is positioned in said first curved hollow tube and said second extension arm is positioned in said second curved hollow tube.

34. The ladder stabilizer of claim 33, wherein said first extension arm has a length equal to at least half the length of said first curved hollow tube and said second extension arm has a length equal to at least half the length of said second curved hollow tube.

35. The ladder stabilizer of claim 34, wherein said support beam has a first side and a second side, said first side has a radius of curvature which conforms to a radius of curvature of said at least one curved hollow tube and said second side is substantially straight.

* * * * *